US010469978B2

(12) United States Patent
Lee et al.

(10) Patent No.: US 10,469,978 B2
(45) Date of Patent: Nov. 5, 2019

(54) AUDIO SIGNAL PROCESSING METHOD AND DEVICE

(71) Applicant: WILUS INSTITUTE OF STANDARDS AND TECHNOLOGY INC., Gyeonggi-do (KR)

(72) Inventors: Taegyu Lee, Gyeonggi-do (KR); Hyun Oh Oh, Gyeonggi-do (KR)

(73) Assignee: WILUS INSTITUTE OF STANDARDS AND TECHNOLOGY INC., Gyeonggi-Do (KR)

( * ) Notice: Subject to any disclaimer, the term of this patent is extended or adjusted under 35 U.S.C. 154(b) by 0 days.

(21) Appl. No.: 16/159,624

(22) Filed: Oct. 13, 2018

(65) Prior Publication Data

US 2019/0090079 A1 Mar. 21, 2019

Related U.S. Application Data

(63) Continuation of application No. 15/974,689, filed on May 9, 2018, now Pat. No. 10,129,685, which is a (Continued)

(30) Foreign Application Priority Data

Jun. 30, 2014 (KR) ..... 10-2014-0081226

(51) Int. Cl.
*H04S 7/00* (2006.01)
*H04S 3/00* (2006.01)

(Continued)

(52) U.S. Cl.
CPC ..... *H04S 7/307* (2013.01); *H04R 3/04* (2013.01); *H04S 3/008* (2013.01); *H04S 7/303* (2013.01);

(Continued)

(58) Field of Classification Search
None
See application file for complete search history.

(56) References Cited

U.S. PATENT DOCUMENTS 5,329,587 A 7/1994 Morgan et al.
5,371,799 A 12/1994 Lowe et al.

(Continued)

FOREIGN PATENT DOCUMENTS

EP 0 700 155 3/1996
EP 2 530 840 12/2012

(Continued)

OTHER PUBLICATIONS

International Preliminary Report on Patentability (Chapter I) for PCT/KR2014/008677 dated Mar. 31, 2016 and its English translation from WIPO.

(Continued)

*Primary Examiner* — Paul W Huber
(74) *Attorney, Agent, or Firm* — Ladas & Parry, LLP

(57) ABSTRACT

The present invention relates to a method and an apparatus for processing an audio signal, and more particularly, to a method and an apparatus for processing an audio signal, which synthesizes an object signal and a channel signal and effectively binaural-render the synthesized signal.
To this end, the present invention provides a method for processing an audio signal, including: receiving an input audio signal including at least one of a multi-channel signal and a multi-object signal; receiving type information of a filter set for binaural filtering of the input audio signal, the type of the filter set being one of a finite impulse response (FIR) filter, a parameterized filter in a frequency domain, and a parameterized filter in a time domain; receiving filter information for binaural filtering based on the type information; and performing the binaural filtering for the input audio signal by using the received filter information, (Continued)

wherein when the type information indicates the parameterized filter in the frequency domain, in the receiving of the filter information, a subband filter coefficient having a length determined for each subband of a frequency domain is received, and in the performing of the binaural filtering, each subband signal of the input audio signal is filtered by using the subband filter coefficient corresponding thereto and an apparatus for processing an audio signal by using the same.

12 Claims, 18 Drawing Sheets

Related U.S. Application Data continuation of application No. 15/825,078, filed on Nov. 28, 2017, now Pat. No. 9,986,365, which is a continuation of application No. 15/300,273, filed as application No. PCT/KR2015/003328 on Apr. 2, 2015, now Pat. No. 9,848,275.

(60) Provisional application No. 61/973,868, filed on Apr. 2, 2014, provisional application No. 62/019,958, filed on Jul. 2, 2014.

(51) Int. Cl.
*H04R 3/04* (2006.01)
*G10L 19/008* (2013.01)

(52) U.S. Cl.
CPC ..... *H04S 7/306* (2013.01); *G10L 19/008* (2013.01); *H04R 2430/03* (2013.01); *H04R 2499/11* (2013.01); *H04R 2499/15* (2013.01); *H04S 2400/01* (2013.01); *H04S 2400/03* (2013.01); *H04S 2400/11* (2013.01); *H04S 2420/01* (2013.01); *H04S 2420/07* (2013.01)

(56) References Cited

U.S. PATENT DOCUMENTS

| | | | |
|---|---|---|---|
| 5,544,249 | A | 8/1996 | Opitz |
| 5,757,931 | A | 5/1998 | Yamada et al. |
| 6,108,626 | A | 8/2000 | Cellario et al. |
| 7,715,575 | B1 | 5/2010 | Sakurai et al. |
| 8,265,284 | B2 | 9/2012 | Villemoes et al. |
| 8,515,104 | B2 | 8/2013 | Dickins et al. |
| 8,788,554 | B2 | 7/2014 | Christoph |
| 9,319,794 | B2 | 4/2016 | Betlehem et al. |
| 9,432,790 | B2 | 8/2016 | Raghuvanshi |
| 9,578,437 | B2 | 2/2017 | Oh et al. |
| 9,832,585 | B2 | 11/2017 | Oh et al. |
| 2005/0117762 | A1 | 6/2005 | Sakurai et al. |
| 2007/0071249 | A1 | 3/2007 | Reining et al. |
| 2007/0100612 | A1 | 5/2007 | Ekstrand et al. |
| 2007/0172086 | A1 | 7/2007 | Dickins et al. |
| 2008/0008342 | A1 | 1/2008 | Sauk |
| 2008/0025519 | A1 | 1/2008 | Yu et al. |
| 2008/0033730 | A1 | 2/2008 | Jot et al. |
| 2008/0192941 | A1 | 8/2008 | Oh et al. |
| 2008/0205658 | A1 | 8/2008 | Breebaart |
| 2008/0253578 | A1 | 10/2008 | Breebaart et al. |
| 2009/0012638 | A1 | 1/2009 | Lou |
| 2009/0041263 | A1 | 2/2009 | Hoshuyama |
| 2009/0043591 | A1 | 2/2009 | Breebaart et al. |
| 2009/0103738 | A1 | 4/2009 | Faure et al. |
| 2009/0252356 | A1 | 10/2009 | Goodwin et al. |
| 2009/0319283 | A1 | 12/2009 | Schnell et al. |
| 2010/0017195 | A1 | 1/2010 | Villemoes |
| 2010/0080112 | A1 | 4/2010 | Bertrand et al. |
| 2010/0169104 | A1 | 7/2010 | Ekstrand et al. |
| 2010/0246832 | A1 | 9/2010 | Villemoes et al. |
| 2010/0246851 | A1 | 9/2010 | Buck et al. |
| 2010/0322431 | A1 | 12/2010 | Lokki et al. |
| 2011/0170721 | A1 | 7/2011 | Dickins et al. |
| 2011/0211702 | A1 | 9/2011 | Mundt et al. |
| 2011/0261948 | A1 | 10/2011 | Deng et al. |
| 2011/0264456 | A1 | 10/2011 | Koppens et al. |
| 2011/0305345 | A1 | 12/2011 | Bouchard et al. |
| 2012/0014528 | A1 | 1/2012 | Wang |
| 2012/0039477 | A1 | 2/2012 | Schijers et al. |
| 2012/0243713 | A1 | 9/2012 | Hess |
| 2013/0028427 | A1 | 1/2013 | Yamamoto et al. |
| 2013/0090933 | A1 | 4/2013 | Villemoes et al. |
| 2013/0182870 | A1 | 7/2013 | Villemoes |
| 2013/0208902 | A1 | 8/2013 | Yamamoto et al. |
| 2013/0272526 | A1 | 10/2013 | Walther |
| 2013/0272527 | A1 | 10/2013 | Oomen et al. |
| 2014/0006037 | A1 | 1/2014 | Honma et al. |
| 2014/0088978 | A1 | 3/2014 | Mundt et al. |
| 2014/0355796 | A1 | 12/2014 | Xiang et al. |
| 2015/0030160 | A1 | 1/2015 | Lee et al. |
| 2015/0223002 | A1 | 8/2015 | Mehta et al. |
| 2015/0358754 | A1 | 12/2015 | Koppens et al. |
| 2016/0189723 | A1 | 6/2016 | Davis |
| 2016/0198281 | A1 | 7/2016 | Oh et al. |
| 2016/0219388 | A1 | 7/2016 | Oh et al. |
| 2016/0249149 | A1 | 8/2016 | Oh et al. |
| 2016/0275956 | A1 | 9/2016 | Lee et al. |
| 2016/0277865 | A1 | 9/2016 | Lee et al. |
| 2016/0323688 | A1 | 11/2016 | Lee et al. |
| 2017/0019746 | A1 | 1/2017 | Oh et al. |
| 2017/0188174 | A1 | 6/2017 | Lee et al. |
| 2018/0048975 | A1 | 2/2018 | Oh et al. |
| 2018/0091927 | A1 | 3/2018 | Lee et al. |
| 2018/0262861 | A1 | 9/2018 | Lee et al. |

FOREIGN PATENT DOCUMENTS

| | | |
|---|---|---|
| EP | 2 541 542 | 1/2013 |
| JP | 2009-531906 | 9/2009 |
| JP | 2009-261022 | 11/2009 |
| JP | 5084264 | 11/2012 |
| KR | 10-2005-0123396 | 12/2005 |
| KR | 10-0754220 | 9/2007 |
| KR | 10-2008-0076691 | 8/2008 |
| KR | 10-2008-0078882 | 8/2008 |
| KR | 10-2008-0098307 | 11/2008 |
| KR | 10-2008-0107422 | 12/2008 |
| KR | 10-2009-0020813 | 2/2009 |
| KR | 10-2009-0047341 | 5/2009 |
| KR | 10-0924576 | 11/2009 |
| KR | 10-2010-0062784 | 6/2010 |
| KR | 10-2010-0063113 | 6/2010 |
| KR | 10-0971700 | 7/2010 |
| KR | 10-2011-0002491 | 1/2011 |
| KR | 10-2012-0006060 | 1/2012 |
| KR | 10-2012-0013893 | 2/2012 |
| KR | 10-1146841 | 5/2012 |
| KR | 10-2013-0045414 | 5/2013 |
| KR | 10-2013-0081290 | 7/2013 |
| KR | 10-1304797 | 9/2013 |
| WO | 2008/003467 | 1/2008 |
| WO | 2009/046223 | 4/2009 |
| WO | 2011/115430 | 9/2011 |
| WO | 2012/023864 | 2/2012 |
| WO | 2015/041476 | 3/2015 |

OTHER PUBLICATIONS

Written Opinion of the International Searching Authority for PCT/KR2014/008677 dated Jan. 23, 2015 and its English translation from WIPO.

International Search Report for PCT/KR2014/008677 dated Jan. 23, 2015 and its English translation from WIPO.

International Preliminary Report on Patentability (Chapter I) for PCT/KR2014/008678 dated Mar. 31, 2016 and its English translation from WIPO.

Written Opinion of the International Searching Authority for PCT/KR2014/008678 dated Jan. 23, 2015 and its English translation from WIPO.

(56) References Cited

OTHER PUBLICATIONS

International Search Report for PCT/KR2014/008678 dated Jan. 23, 2015 and its English translation from WIPO.
International Preliminary Report on Patentability (Chapter I) for PCT/KR2014/008679 dated Mar. 31, 2016 and its English translation from WIPO.
Written Opinion of the International Searching Authority for PCT/KR2014/008679 dated Jan. 26, 2015 and its English translation from WIPO.
International Search Report for PCT/KR2014/008679 dated Jan. 26, 2015 and its English translation from WIPO.
International Preliminary Report on Patentability (Chapter I) for PCT/KR2014/009975 dated May 6, 2016 and its English translation from WIPO.
Written Opinion of the International Searching Authority for PCT/KR2014/009975 dated Jan. 26, 2015 and its English translation from WIPO.
International Search Report for PCT/KR2014/009975 dated Jan. 26, 2015 and its English translation from WIPO.
International Preliminary Report on Patentability (Chapter I) for PCT/KR2014/009978 dated May 6, 2016 and its English translation from WIPO.
Written Opinion of the International Searching Authority for PCT/KR2014/009978 dated Jan. 20, 2015 and its English translation from WIPO.
International Search Report for PCT/KR2014/009978 dated Jan. 20, 2015 and its English translation from WIPO.
International Preliminary Report on Patentability (Chapter I) for PCT/KR2014/012758 dated Jul. 7, 2016 and its English translation from WIPO.
Written Opinion of the International Searching Authority for PCT/KR2014/012758 dated Apr. 10, 2015 and its English machine translation by Google Translate.
International Search Report for PCT/KR2014/012758 dated Apr. 13, 2015 and its English translation from WIPO.
International Preliminary Report on Patentability (Chapter I) for PCT/KR2014/012764 dated Jul. 7, 2016 and its English translation from WIPO.
Written Opinion of the International Searching Authority for PCT/KR2014/012764 dated Apr. 13, 2015 and its English translation from WIPO.
International Search Report for PCT/KR2014/012764 dated Apr. 13, 2015 and its English translation from WIPO.
International Preliminary Report on Patentability (Chapter I) for PCT/KR2014/012766 dated Jul. 7, 2016 and its English translation from WIPO.
Written Opinion of the International Searching Authority for PCT/KR2014/012766 dated Apr. 13, 2015 and its English translation from WIPO.
International Search Report for PCT/KR2014/012766 dated Apr. 13, 2015 and its English translation from WIPO.
Written Opinion of the International Searching Authority for PCT/KR2015/002669 dated Jun. 5, 2015 and its English translation provided by Applicant's foreign counsel.
International Search Report for PCT/KR2015/002669 dated Jun. 5, 2015 and its English translation from WIPO.
Written Opinion of the International Searching Authority for PCT/KR2015/003328 dated Jun. 22, 2015 and its English translation provided by Applicant's foreign counsel.
International Search Report for PCT/KR2015/003328 dated Jun. 22, 2015 and its English translation from WIPO.
Written Opinion of the International Searching Authority for PCT/KR2015/003330 dated Jun. 5, 2015 and its English translation provided by Applicant's foreign counsel.
International Search Report for PCT/KR2015/003330 dated Jun. 5, 2015 and its English translation from WIPO.
Astik Biswas et al., "Admissible wavelet packet features based on human inner ear frequency response for Hindi consonant recognition", Computers & Electrical Engineering, Feb. 22, 2014, p. 1111-1122.
Jeroen Breebaart et al., "Binaural Rendering in MPEG Surround", EURASIP Journal on advances in signal processing, Jan. 2, 2008, vol. 2008, No. 7, pp. 1-14.
Office Action dated Apr. 6, 2016 for Korean Patent Application No. 10-2016-7001431 and its English translation provided by Applicant's foreign counsel.
Office Action dated Apr. 12, 2016 for Korean Patent Application No. 10-2016-7001432 and its English translation provided by Applicant's foreign counsel.
Non-Final Office Action dated Jun. 13, 2016 for U.S. Appl. No. 14/990,814 (now published as U.S. 2016/0198281).
Non-Final Office Action dated Jun. 13, 2016 for U.S. Appl. No. 15/145,822.
Emerit Marc et al: "Efficient Binaural Filtering in QMF Domain for BRIR", AES Convention 122; May 2007, AES, 60 East 42$^{nd}$ Street, Room 2520, New York 10165-2520, USA, May 1, 2007 (May 1, 2007), XP040508167 the whole document.
Smith, Julious Orion. "Physical Audio Signal Processing: for virtual musical instruments and audio effects." pp. 1-3, 2006.
Office Action dated Mar. 20, 2017 for Korean Patent Application No. 10-2016-7006858 and its English translation provided by Applicant's foreign counsel.
Office Action dated Mar. 20, 2017 for Korean Patent Application No. 10-2016-7006859 and its English translation provided by Applicant's foreign counsel.
Office Action dated Mar. 20, 2017 for Korean Patent Application No. 10-2016-7009852 and its English translation provided by Applicant's foreign counsel.
Office Action dated Mar. 20, 2017 for Korean Patent Application No. 10-2016-7009853 and its English translation provided by Applicant's foreign counsel.
Non-Final Office Action dated Mar. 22, 2017 for U.S. Appl. No. 15/022,923 (now published as U.S. 2016/0219388).
Non-Final Office Action dated Feb. 21, 2017 for U.S. Appl. No. 15/022,922 (now published as U.S. 2016/0234620).
Non-Final Office Action dated Mar. 16, 2017 for U.S. Appl. No. 15/107,462 (now published as U.S. 2016/0323688).
Notice of Allowance dated Jul. 19, 2017 for U.S. Appl. No. 15/107,462 (now published as U.S. 2016/0323688).
Extended European Search Report dated Apr. 28, 2017 for European Patent Application No. 14846160.1.
Extended European Search Report dated Apr. 28, 2017 for European Patent Application No. 14845972.0.
Extended European Search Report dated Apr. 28, 2017 for European Patent Application No. 14846500.8.
Final Office Action dated Aug. 23, 2017 for U.S. Appl. No. 15/022,922 (now published as U.S. 2016/0234620).
Office Action dated Jun. 5, 2017 for Korean Patent Application No. 10-2016-7016590 and its English translation provided by Applicant's foreign council.
Extended European Search Report dated Jun. 1, 2017 for European Patent Application No. 14856742.3.
Extended European Search Report dated Jun. 1, 2017 for European Patent Application No. 14855415.7.
Extended European Search Report dated Jul. 27, 2017 for European Patent Application No. 14875534.1.
"Information technology—MPEG audio technologies—part 1: MPEG Surround", ISO/IEC 23003-1:2007, IEC, 3, Rue De Varembe, PO Box 131, CH-1211 Geneva 20, Switzerland, Jan. 29, 2007 (Jan. 29, 2007), pp. 1-280, XP082000863, pp. 245, 249.
David Virette et al.: "Description of France Telecom Binaural Decoding proposal for MPEG Surround", 76, MPEG Meeting, Apr. 3, 2006-Apr. 7, 2006; Montreux; (Motion Picture Expert Group or ISO/IEC JTC1/SC29/WG11), No. M13276, 30.
Torres J C B et al.: "Low-order modeling of head-related transfer functions using wavelet transforms", Proceedings/2004 IEEE International Symposium on Circuits and Systems: May 23-26, 2004, Sheraton Vancouver Wall.
ISO/IEC FDIS 23003-1:2006(E). Information technology—MPEG audio technologies Part 1: MPEG Surround. ISO/IEC JTC 1/SC 29/WG 11. Jul. 21, 2006, pp. i-283.
Notice of Allowance dated Aug. 28, 2017 for U.S. Appl. No. 15/300,277 (now published as U.S. 2017/0188175).

(56) References Cited

OTHER PUBLICATIONS

Extended European Search Report dated Sep. 15, 2017 for EP Patent Application No. 15764805.6.
Notice of Allowance dated Aug. 15, 2017 for U.S. Appl. No. 15/300,273 (now published as U.S. 2017/0188174).
Notice of Allowance dated May 5, 2017 for U.S. Appl. No. 15/124,029 (now published as US 2017/0019746).
Notice of Allowance dated Jan. 30, 2018 for U.S. Appl. No. 15/825,078 (now published as US 2018/0091927).
Notice of Allowance dated Jul. 6, 2018 for U.S. Appl. No. 15/974,689 (now published as US 2018/0262861).
Non-Final Office Action dated Apr. 5, 2018 for U.S. Appl. No. 15/031,275 (now published as U.S. 2016/0277865).
Non-Final Office Action dated Jun. 15, 2018 for U.S. Appl. No. 15/022,923 (now published as U.S. 2016/0219388).
Advisory Office Action dated Apr. 25, 2018 for U.S. Appl. No. 15/022,923 (now published as U.S. 2016/0219388).
Notice of Allowance dated May 3, 2018 for U.S. Appl. No. 15/795,180 (now published as U.S. 2018/0048975).
Final Office Action dated May 7, 2018 for U.S. Appl. No. 15/031,274 (now published as U.S. 2016/0275956).
Notice of Allowance dated May 9, 2018 for Chinese Application No. 201580018973.0 and its English translation provided by Applicant's foreign council.
Office Action dated Jun. 15, 2018 for Canadian Application No. 2,934,856.
Extended European Search Report dated Dec. 21, 2017 for EP Application No. 15774085.3.
Marc Emerit et al: "Thoughts on Binaural Decoder Parameterization", 106. MPEG Meeting; Oct. 28, 2013-Nov. 1, 2013; Geneva; (Motion Picture Expert Group or ISO/IEC JTC1/SC29/WG11), No. m31427, Oct. 23, 2013 (Oct. 23, 2013), XP030059879, 1st paragraph of introduction, p. 5, second paragraph; table 2.
Jeongil Seo et al: "Technical Description of ETRI/Yonsei/WILUS Binaural CE Proposal in MPEG-H 3D Audio", 107. MPEG Meeting; Jan. 13, 2014-Jan. 17, 2014; San Jose; (Motion Picture Expert Group or ISO/IEC JTC1/SC29/WG11), No. m32223, Jan. 8, 2014 (Jan. 8, 2014), XP030060675, Section II: first to third paragraph, Section 4.2; figure 1, Section III: first paragraph.
Taegyu Lee et al.: "Updated Normative Interface for Binaural Data", 109. MPEG Meeting; Jul. 7, 2014-Jul. 11, 2014; Sapporo; (Motion Picture Expert Group or ISO/IEC JTC1/SC29/WG11); No. m33615, Jun. 2, 2014 (Jun. 2014), XP030061988, p. 3, p. 19, VOFF related parameters; table 2.
Werner De Bruijn et al.: "Normative Interface for Binaural Data", 109. MPEG Meeting; Jul. 7, 2014-Jul. 11, 2014; Sapporo; (Motion Picture Expert Group or ISO/IEC JTC1/SC29/WG11), No. m34221, Jul. 2, 2014 (Jul. 2, 2014), XP030062594, p. 11, VOFF related parameters; table 2.
Non-Final Office Action dated Jan. 24, 2019 for U.S. Appl. No. 15/942,588.
Final Office Action dated Feb. 7, 2019 for U.S. Appl. No. 15/022,923.
Office Action dated Jan. 16, 2019 for Canadian Patent Application No. 2,924,458.
Office Action dated Feb. 7, 2019 for European Patent Application No. 14 855 415.7.
Notice of Allowance dated Feb. 8, 2019 for European Patent Application No. 14 856 742.3.

| Syntax | No. of bits | Mnemonic | |
|---|---|---|---|
| BinauralRendering() | | | S1100 |
| { | | | |
| bsFileSignature; | 32 | bslbf | S1101 |
| bsFileVersion; | 8 | uimsbf | S1102 |
| bsNumCharName; | 8 | uimsbf | S1103 |
| for (i=0; i<bsNumCharName; i++) { | | | |
| bsName[i]; | 8 | bslbf | S1104 |
| } | | | |
| ⋮ | | | |
| bsNumBinauralDataRepresentation; | 4 | uimsbf | S1110 |
| for (r=0; r<bsNumBinauralDataRepresentation; r++) { | | | |
| brirSamplingFrequencyIndex; | 5 | uimsbf | S1111 |
| if (brirSamplingFrequencyIndex == 0x1f) { | | | |
| brirSamplingFrequency; | 24 | uimsbf | S1112 |
| } | | | |
| ⋮ | | | |
| bsBinauralDataFormatID; | 2 | uimsbf | S1113 |
| ByteAlign(); | | | S1114 |
| switch (bsBinauralDataFormatID) { | | | S1115 |
| case 0: | | | |
| BinauralFIRData(); | | | S1200 |
| break; | | | |
| case 1: | | | |
| FdBinauralRendererParam(); | | | S1300 |
| break; | | | |
| case 2: | | | |
| TdBinauralRendererParam(); | | | S1350 |
| break; | | | |
| } | | | |
| } | | | |
| } | | | |

*FIG. 11*

| Syntax | No. of bits | Mnemonic | |
|---|---|---|---|
| BinauralFirData() | | | S1200 |
| { | | | |
| bsNumCoefs; | 24 | uimsbf | S1201 |
| for (pos=0; pos<nBrirPairs; pos++) { | | | |
| for (i=0; i<bsNumCoefs; i++) { | | | |
| bsFirCoefLeft[pos][i]; | 32 | bslbf | S1202 |
| bsFirCoefRight[pos][i]; | 32 | bslbf | S1203 |
| } | | | |
| } | | | |
| bsAllCutFreq; | 32 | bslbf | S1210 |
| if (bsAllCutFreq == 0) { | | | |
| for (pos=0; pos<nBrirPairs; pos++) { | | | |
| bsCutFreqLeft[pos]; | 32 | bslbf | S1211 |
| bsCutFreqRight[pos]; | 32 | bslbf | S1212 |
| } | | | |
| } else { | | | |
| for (pos=0; pos<nBrirPairs; pos++) { | | | |
| bsCutFreqLeft[pos] = bsAllCutFreq; | | | S1213 |
| bsCutFreqRight[pos] = bsAllCutFreq; | | | S1214 |
| } | | | |
| } | | | |
| } | | | |

*FIG. 12*

| Syntax | No. of bits | Mnemonic | |
|---|---|---|---|
| FdBinauralRendererParam() | | | S1300 |
| { | | | |
| flagHrir; | 1 | bslbf | S1302 |
| dInit; | 10 | uimsbf | S1303 |
| kMax; | 6 | uimsbf | S1304 |
| kConv; | 6 | uimsbf | S1305 |
| kAna; | 6 | uimsbf | S1306 |
| VoffBrirParam(); | | | S1400 |
| if (flagHrir == 0) { | | | |
| SfrBrirParam(); | | | S1450 |
| } | | | |
| QtdlBrirParam(); | | | S1500 |
| } | | | |

*FIG. 13*

| Syntax | No. of bits | Mnemonic | |
|---|---|---|---|
| VoffBrirParam() | | | S1400 |
| { | | | |
| nBitNFilter; | 4 | uimsbf | S1401 |
| nBitNFft; | 3 | uimsbf | S1402 |
| nBitNBlk; | 3 | uimsbf | S1403 |
| for (k=0; k<kMax; k++) { | | | |
| nFilter[k]; | nBitNFilter | uimsbf | S1410 |
| nFft[k]; | nBitNFft | uimsbf | S1411 |
| fftLength = pow(2, nFft[k]); | | | S1412 |
| nBlk[k]; | nBitNBlk | uimsbf | S1413 |
| for (b=0; b<nBlk[k]; b++) { | | | |
| for (nr=0; nr<nBrirPairs; nr++) { | | | |
| for (v=0; v<fftLength; v++) { | | | |
| VoffCoeffLeftReal[k],[b],[nr],[v]; | 32 | bslbf | S1420 |
| VoffCoeffLeftImag[k],[b],[nr],[v]; | 32 | bslbf | S1421 |
| VoffCoeffRightReal[k],[b],[nr],[v]; | 32 | bslbf | S1422 |
| VoffCoeffRightImag[k],[b],[nr],[v]; | 32 | bslbf | S1423 |
| } | | | |
| } | | | |
| } | | | |
| } | | | |
| } | | | |

*FIG. 14*

| Syntax | No. of bits | Mnemonic | |
|---|---|---|---|
| QtdlBrirParam() | | | S1500 |
| { | | | |
| for (k=0; k<kMax-kConv; k++) { | | | |
| nBitQtdlLag[k]; | 4 | uimsbf | S1501 |
| for (nr=0; nr<nBrirPairs; nr++) { | | | |
| QtdlGainLeftReal[k][nr]; | 32 | bslbf | S1502 |
| QtdlGainLeftImag[k][nr]; | 32 | bslbf | S1503 |
| QtdlGainRightReal[k][nr]; | 32 | bslbf | S1504 |
| QtdlGainRightImag[k][nr]; | 32 | bslbf | S1505 |
| QtdlLagLeft[k][nr]; | nBitQtdlLag[k] | uimsbf | S1506 |
| QtdlLagRightl[k][nr]; | nBitQtdlLag[k] | uimsbf | S1507 |
| } | | | |
| } | | | |
| } | | | |

*FIG. 15*

| Syntax | No. of bits | Mnemonic | |
|---|---|---|---|
| FdBinauralRendererParam2() | | | S1700 |
| { | | | |
| nOut = 2; | | | S1701 |
| flagHrir; | 1 | bslbf | S1702 |
| dInit; | 10 | uimsbf | S1703 |
| kMax; | 6 | uimsbf | S1704 |
| kConv; | 6 | uimsbf | S1705 |
| kAna; | 6 | uimsbf | S1706 |
| nVBER; | 5 | uimsbf | S1707 |
| flagChannelDependent; | 1 | bslbf | S1708 |
| for (n=0; n<nVBER; n++) { | | | |
| VoffComplexity[n]; | 8 | uimsbf | S1710 |
| if (flagChannelDependent) { | | | |
| for (nr=0; nr<nBrirPairs; nr++) { | | | |
| nBitNFilter[nr][n]; | 4 | uimsbf | S1711 |
| for (k=0; k<kMax; k++) { | | | |
| nFilter[nr][n][k]; | nBitNFilter[nr][n] | uimsbf | S1712 |
| } | | | |
| } | | | |
| else { | | | |
| nBitNFilter[n]; | 4 | uimsbf | S1713 |
| for (k=0; k<kMax; k++) { | | | |
| nFilter[n][k]; | nBitNFilter[nr][n] | uimsbf | S1714 |
| } | | | |
| } | | | |
| } | | | |
| VoffBrirParam2(); | | | S1800 |
| if (!flagHrir) { | | | |
| SftBrirParam(); | | | S1450 |
| } | | | |
| QtdlBrirParam(); | | | S1500 |
| } | | | |

*FIG. 17*

| Syntax | No. of bits | Mnemonic | |
|---|---|---|---|
| VoffBrirParam2() | | | S1800 |
| { | | | |
| for (k=0; k<kMax; k++) { | | | |
| for (nr=0; nr<nBrirPairs; nr++) { | | | |
| for (v=0; v<nFilter[nVBER-1][k]; v++) { | | | |
| QMFBRIRLeftReal[k][nr][v]; | 32 | bslbf | S1820 |
| QMFBRIRLeftImag[k][nr][v]; | 32 | bslbf | S1821 |
| QMFBRIRRightReal[k][nr][v]; | 32 | bslbf | S1822 |
| QMFBRIRRightImag[k][nr][v]; | 32 | bslbf | S1823 |
| } | | | |
| } | | | |
| } | | | |
| } | | | |

*FIG. 18*

AUDIO SIGNAL PROCESSING METHOD AND DEVICE

TECHNICAL FIELD

The present invention relates to a method and an apparatus for processing an audio signal, and more particularly, to a method and an apparatus for processing an audio signal, which synthesize an object signal and a channel signal and effectively perform binaural rendering of the synthesized signal.

BACKGROUND ART 3D audio collectively refers to a series of signal processing, transmitting, encoding, and reproducing technologies for providing sound having presence in a 3D space by providing another axis corresponding to a height direction to a sound scene on a horizontal plane (2D) provided in surround audio in the related art. In particular, in order to provide the 3D audio, more speakers than the related art should be used or otherwise, even though less speakers than the related art are used, a rendering technique which makes a sound image at a virtual position where a speaker is not present is required.

It is anticipated that the 3D audio will be an audio solution corresponding to an ultra high definition (UHD) TV and it is anticipated that the 3D audio will be applied in various fields including theater sound, a personal 3DTV, a tablet, a smart phone, and a cloud game in addition to sound in a vehicle which evolves to a high-quality infotainment space.

Meanwhile, as a type of a sound source provided to the 3D audio, a channel based signal and an object based signal may be present. In addition, a sound source in which the channel based signal and the object based signal are mixed may be present, and as a result, a user may have a new type of listening experience.

DISCLOSURE

Technical Problem

The present invention has been made in an effort to implement a filtering process which requires a high computational amount with very low computational amount while minimizing loss of sound quality in binaural rendering for conserving an immersive perception of an original signal in reproducing a multi-channel or multi-object signal in stereo.

The present invention has also been made in an effort to minimize spread of distortion through a high-quality filter when the distortion is contained in an input signal.

The present invention has also been made in an effort to implement a finite impulse response (FIR) filter having a very large length as a filter having a smaller length.

The present invention has also been made in an effort to minimize distortion of a destructed part by omitted filter coefficients when performing filtering using an abbreviated FIR filter.

The present invention has also been made in an effort to provide a channel dependent binaural rendering method and a scalable binaural rendering method.

Technical Solution

In order to achieve the objects, the present invention provides a method and an apparatus for processing an audio signal as below.

An exemplary embodiment of the present invention provides a method for processing an audio signal, including: receiving an input audio signal including at least one of a multi-channel signal and a multi-object signal; receiving type information of a filter set for binaural filtering of the input audio signal, the type of the filter set being one of a finite impulse response (FIR) filter, a parameterized filter in a frequency domain, and a parameterized filter in a time domain; receiving filter information for binaural filtering based on the type information; and performing the binaural filtering for the input audio signal by using the received filter information, wherein when the type information indicates the parameterized filter in a frequency domain, in the receiving of the filter information, a subband filter coefficients having a length determined for each subband of a frequency domain is received, and in the performing of the binaural filtering, each subband signal of the input audio signal is filtered by using the subband filter coefficients corresponding thereto.

Another exemplary embodiment of the present invention provides an apparatus for processing an audio signal for performing binaural rendering of an input audio signal including at least one of a multi-channel signal and a multi-object signal, wherein the apparatus for processing an audio signal receives type information of a filter set for binaural filtering of the input audio signal, the type of the filter set being one of a finite impulse response (FIR) filter, a parameterized filter in a frequency domain, and a parameterized filter in a time domain, receives filter information for binaural filtering based on the type information, and performs the binaural filtering for the input audio signal by using the received filter information, and wherein when the type information indicates the parameterized filter in the frequency domain, the apparatus for processing an audio signal receives subband filter coefficients having a length determined for each subband of a frequency domain and filters each subband signal of the input audio signal by using the subband filter coefficients corresponding thereto.

The length of each subband filter coefficients may be determined based on reverberation time information of the corresponding subband, which is obtained from a proto-type filter coefficients, and the length of at least one subband filter coefficients obtained from the same proto-type filter coefficients may be different from the length of another subband filter coefficients.

The method may further include: when the type information indicates the parameterized filter in the frequency domain, receiving information on the number of frequency bands to perform the binaural rendering and information on the number of frequency bands to perform convolution; receiving a parameter for performing tap-delay line filtering with respect to each subband signal of a high-frequency subband group having a frequency band to perform the convolution as a boundary; and performing the tap-delay line filtering for each subband signal of the high-frequency group by using the received parameter.

In this case, the number of subbands of the high-frequency subband group performing the tap-delay line filtering may be determined based on a difference between the number of frequency bands to perform the binaural rendering and the number of frequency bands to perform the convolution.

The parameter may include delay information extracted from the subband filter coefficients corresponding to each subband signal of the high-frequency group and gain information corresponding to the delay information.

When the type information indicates the FIR filter, the receiving the filter information step receives the proto-type filter coefficients corresponding to each subband signal of the input audio signal.

Yet another exemplary embodiment of the present invention provides a method for processing an audio signal, including: receiving an input audio signal including a multi-channel signal; receiving filter order information variably determined for each subband of a frequency domain; receiving block length information for each subband based on a fast Fourier transform length for each subband of filter coefficients for binaural filtering of the input audio signal; receiving Variable Order Filtering in Frequency-domain (VOFF) coefficients corresponding to each subband and each channel of the input audio signal per block of the corresponding subband, a total sum of lengths of the VOFF coefficients corresponding to the same subband and the same channel being determined based on the filter order information of the corresponding subband; and filtering each subband signal of the input audio signal by using the received VOFF coefficients to generate a binaural output signal.

Still yet another exemplary embodiment of the present invention provides an apparatus for processing an audio signal for performing binaural rendering of an input audio signal including a multi-channel signal, the apparatus comprising: a fast convolution unit configured to perform rendering of direct sound and early reflection sound parts for the input audio signal, wherein the fast convolution unit receives the input audio signal, receives filter order information variably determined for each subband of a frequency domain, receives block length information for each subband based on a fast Fourier transform length for each subband of filter coefficients for binaural filtering of the input audio signal, receives Variable Order Filtering in Frequency-domain (VOFF) coefficients corresponding to each subband and each channel of the input audio signal per block wise of the corresponding subband, a total sum of lengths of the VOFF coefficients corresponding to the same subband and the same channel being determined based on the filter order information of the corresponding subband; and filters each subband signal of the input audio signal by using the received VOFF coefficients to generate a binaural output signal.

In this case, the filter order may be determined based on reverberation time information of the corresponding subband, which is obtained from a proto-type filter coefficients, and the filter order of at least one subband obtained from the same proto-type filter coefficients may be different from the filter order of another subband.

The length of the VOFF coefficients per block may be determined as a value of power of 2 having the block length information of the corresponding subband as an exponent value.

The generating of the binaural output signal may include partitioning each frame of the subband signal into subframe units determined based on the predetermined block length, and performing fast convolution between the partitioned subframes and the VOFF coefficients.

In this case, the length of the subframe may be determined as a value which is a half as large as the predetermined block length, and the number of partitioned subframes may be determined based on a value obtained by dividing the total length of the frame by the length of the subframe.

Advantageous Effects

According to the exemplary embodiments of the present invention, when the binaural rendering for a multi-channel or multi-object signal is performed, a computational amount can be significantly reduced while minimizing the loss of sound quality.

In addition, it is possible to achieve binaural rendering having high sound quality for a multi-channel or multi-object audio signal, which real-time processing has been impossible in a low-power device in the related art.

The present invention provides a method that efficiently performs filtering of various types of multimedia signals including an audio signal with a small computational amount.

According to the present invention, methods including channel dependent binaural rendering, scalable binaural rendering, and the like are provided to control both the quality and the computational amount of the binaural rendering.

DESCRIPTION OF DRAWINGS

FIGS. 11 to 15 are diagrams illustrating an exemplary embodiment of syntaxes for implementing a method for processing an audio signal according to the present invention.

FIGS. 17 and 18 are diagrams illustrating syntaxes of functions for implementing a variant exemplary embodiment of the present invention.

BEST MODE

Terms used in the specification adopt general terms which are currently widely used as possible by considering functions in the present invention, but the terms may be changed depending on an intention of those skilled in the art, customs, or emergence of new technology. Further, in a specific case, terms arbitrarily selected by an applicant may be used and in this case, meanings thereof will be disclosed in the corresponding description part of the invention. Accordingly, we intend to discover that a term used in the specification should be analyzed based on not just a name of the term but a substantial meaning of the term and contents throughout the specification.

Figure 1:
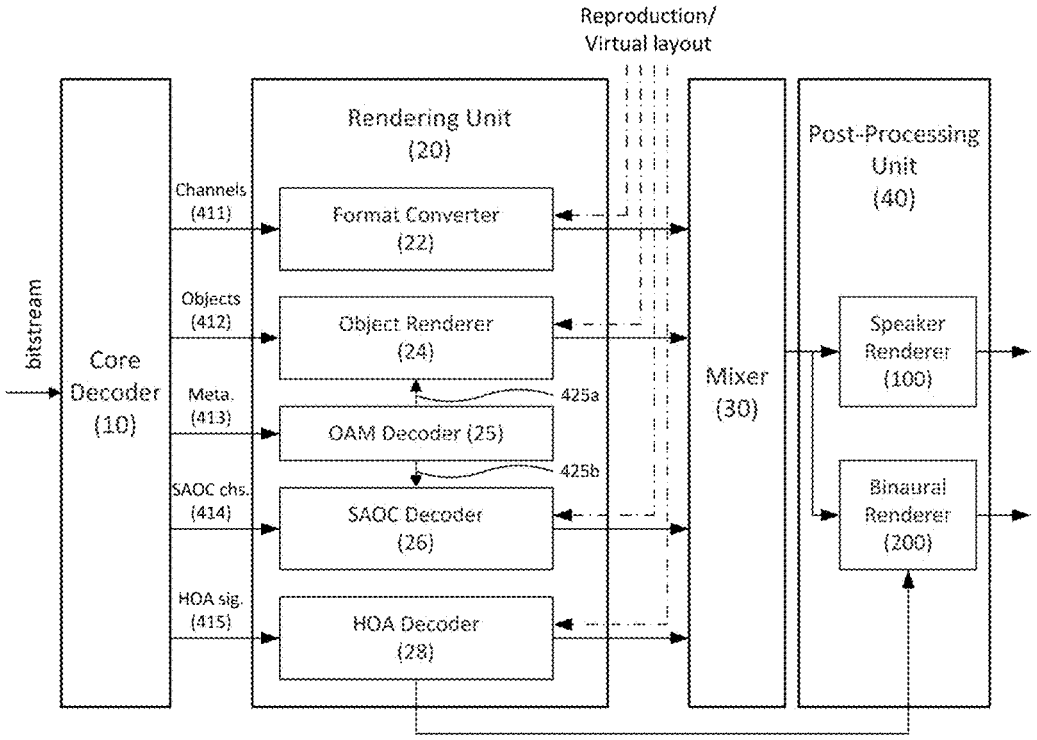
FIG. 1 is a block diagram illustrating an audio signal decoder according to an exemplary embodiment of the present invention.

FIG. 1 is a block diagram illustrating an audio decoder according to an additional exemplary embodiment of the present invention. The audio decoder of the present invention includes a core decoder 10, a rendering unit 20, a mixer 30, and a post-processing unit 40.

First, the core decoder 10 decodes the received bitstream and transfers the decoded bitstream to the rendering unit 20. In this case, the signal output from the core decoder 10 and transferred to the rendering unit may include a loudspeaker channel signal 411, an object signal 412, an SAOC channel signal 414, an HOA signal 415, and an object metadata bitstream 413. A core codec used for encoding in an encoder may be used for the core decoder 10 and for example, an MP3, AAC, AC3 or unified speech and audio coding (USAC) based codec may be used.

Meanwhile, the received bitstream may further include an identifier which may identify whether the signal decoded by the core decoder 10 is the channel signal, the object signal, or the HOA signal. Further, when the decoded signal is the channel signal 411, an identifier which may identify which channel in the multi-channels each signal corresponds to (for example, corresponding to a left speaker, corresponding to a top rear right speaker, and the like) may be further included in the bitstream. When the decoded signal is the object signal 412, information indicating at which position of the reproduction space the corresponding signal is reproduced may be additionally obtained like object metadata information 425*a* and 425*b* obtained by decoding the object metadata bitstream 413.

According to the exemplary embodiment of the present invention, the audio decoder performs flexible rendering to improve the quality of the output audio signal. The flexible rendering may mean a process of converting a format of the decoded audio signal based on a loudspeaker configuration (a reproduction layout) of an actual reproduction environment or a virtual speaker configuration (a virtual layout) of a binaural room impulse response (BRIR) filter set. In general, in speakers disposed in an actual living room environment, both an orientation angle and a distance are different from those of a standard recommendation. As a height, a direction, a distance from the listener of the speaker, and the like are different from the speaker configuration according to the standard recommendation, when an original signal is reproduced at a changed position of the speakers, it may be difficult to provide an ideal 3D sound scene. In order to effectively provide a sound scene intended by a contents producer even in the different speaker configurations, the flexible rendering is required, which corrects a change depending on a positional difference among the speakers by converting the audio signal.

Therefore, the rendering unit 20 renders the signal decoded by the core decoder 10 to a target output signal by using reproduction layout information or virtual layout information. The reproduction layout information may indicate a configuration of target channels which is expressed as loudspeaker layout information of the reproduction environment. Further, the virtual layout information may be obtained based on a binaural room impulse response (BRIR) filter set used in the binaural renderer 200 and a set of positions corresponding to the virtual layout may be constituted by a subset of a set of positions corresponding to the BRIR filter set. In this case, the set of positions of the virtual layout may indicate positional information of respective target channels. The rendering unit 20 may include a format converter 22, an object renderer 24, an OAM decoder 25, an SAOC decoder 26, and an HOA decoder 28. The rendering unit 20 performs rendering by using at least one of the above configurations according to a type of the decoded signal.

The format converter 22 may also be referred to as a channel renderer and converts the transmitted channel signal 411 into the output speaker channel signal. That is, the format converter 22 performs conversion between the transmitted channel configuration and the speaker channel configuration to be reproduced. When the number of (for example, 5.1 channels) of output speaker channels is smaller than the number (for example, 22.2 channels) of transmitted channels or the transmitted channel configuration and the channel configuration to be reproduced are different from each other, the format converter 22 performs downmix or conversion of the channel signal 411. According to the exemplary embodiment of the present invention, the audio decoder may generate an optimal downmix matrix by using a combination between the input channel signal and the output speaker channel signal and perform the downmix by using the matrix. Further, a pre-rendered object signal may be included in the channel signal 411 processed by the format converter 22. According to the exemplary embodiment, at least one object signal may be pre-rendered and mixed to the channel signal before encoding the audio signal. The mixed object signal may be converted into the output speaker channel signal by the format converter 22 together with the channel signal.

The object renderer 24 and the SAOC decoder 26 performs rendering on the object based audio signal. The object based audio signal may include a discrete object waveform and a parametric object waveform. In the case of the discrete object waveform, the respective object signals are provided to the encoder in a monophonic waveform and the encoder transmits the respective object signals by using single channel elements (SCEs). In the case of the parametric object waveform, a plurality of object signals is downmixed to at least one channel signal and features of the respective objects and a relationship among the characteristics are expressed as a spatial audio object coding (SAOC) parameter. The object signals are downmixed and encoded with the core codec and in this case, the generated parametric information is transmitted together to the decoder.

Meanwhile, when the individual object waveforms or the parametric object waveform is transmitted to the audio decoder, compressed object metadata corresponding thereto may be transmitted together. The object metadata designates a position and a gain value of each object in the 3D space by quantizing an object attribute by the unit of a time and a space. The OAM decoder 25 of the rendering unit 20 receives a compressed object metadata bitstream 413 and decodes the received compressed object metadata bitstream 413 and transfers the decoded object metadata bitstream 413 to the object renderer 24 and/or the SAOC decoder 26.

The object renderer 24 performs rendering each object signal 412 according to a given reproduction format by using the object metadata information 425*a*. In this case, each object signal 412 may be rendered to specific output channels based on the object metadata information 425*a*. The SAOC decoder 26 restores the object/channel signal from the SAOC channel signal 414 and the parametric information. Further, the SAOC decoder 26 may generate the output audio signal based on the reproduction layout information and the object metadata information 425*b*. That is, the SAOC decoder 26 generates the decoded object signal by using the SAOC channel signal 414 and performs rendering of mapping the decoded object signal to the target output signal. As described above, the object renderer 24 and the SAOC decoder 26 may render the object signal to the channel signal.

The HOA decoder 28 receives the higher order ambisonics (HOA) signal 415 and HOA additional information and decodes the HOA signal and the HOA additional information. The HOA decoder 28 models the channel signal or the object signal by a separate equation to generate a sound scene. When a spatial position of a speaker is selected in the generated sound scene, the channel signal or the object signal may be rendered to a speaker channel signal.

Meanwhile, although not illustrated in FIG. 1, when the audio signal is transferred to the respective components of the rendering unit 20, dynamic range control (DRC) may be performed as a preprocessing procedure. The DRC limits a dynamic range of the reproduced audio signal to a predetermined level and adjusts sound smaller than a predetermined threshold to be larger and sound larger than the predetermined threshold to be smaller.

The channel based audio signal and object based audio signal processed by the rendering unit 20 are transferred to a mixer 30. The mixer 30 mixes partial signals rendered by respective sub-units of the rendering unit 20 to generate a mixer output signal. When the partial signals are matched with the same position on the reproduction/virtual layout, the partial signals are added to each other and when the partial signals are matched with positions which are not the same, the partial signals are mixed to output signals corresponding to separate positions, respectively. The mixer 30 may determine whether offset interference occurs in the partial signals which are added to each other and further perform an additional process for preventing the offset interference. Further, the mixer 30 adjusts delays of a channel based waveform and a rendered object waveform and aggregates the adjusted waveforms by the unit of a sample. The audio signal aggregated by the mixer 30 is transferred to a post-processing unit 40.

The post-processing unit 40 includes the speaker renderer 100 and the binaural renderer 200. The speaker renderer 100 performs post-processing for outputting the multi-channel and/or multi-object audio signal transferred from the mixer 30. The post-processing may include the dynamic range control (DRC), loudness normalization (LN), and a peak limiter (PL). The output signal of the speaker renderer 100 is transferred to a loudspeaker of the multi-channel audio system to be output.

The binaural renderer 200 generates a binaural downmix signal of the multi-channel and/or multi-object audio signals. The binaural downmix signal is a 2-channel audio signal that allows each input channel/object signal to be expressed by the virtual sound source positioned in 3D. The binaural renderer 200 may receive the audio signal supplied to the speaker renderer 100 as an input signal. The binaural rendering may be performed based on the binaural room impulse response (BRIR) filters and performed on a time domain or a QMF domain. According to the exemplary embodiment, as the post-processing procedure of the binaural rendering, the dynamic range control (DRC), the loudness normalization (LN), and the peak limiter (PL) may be additionally performed. The output signal of the binaural renderer 200 may be transferred and output to 2-channel audio output devices such as a head phone, an earphone, and the like.

Figure 2:
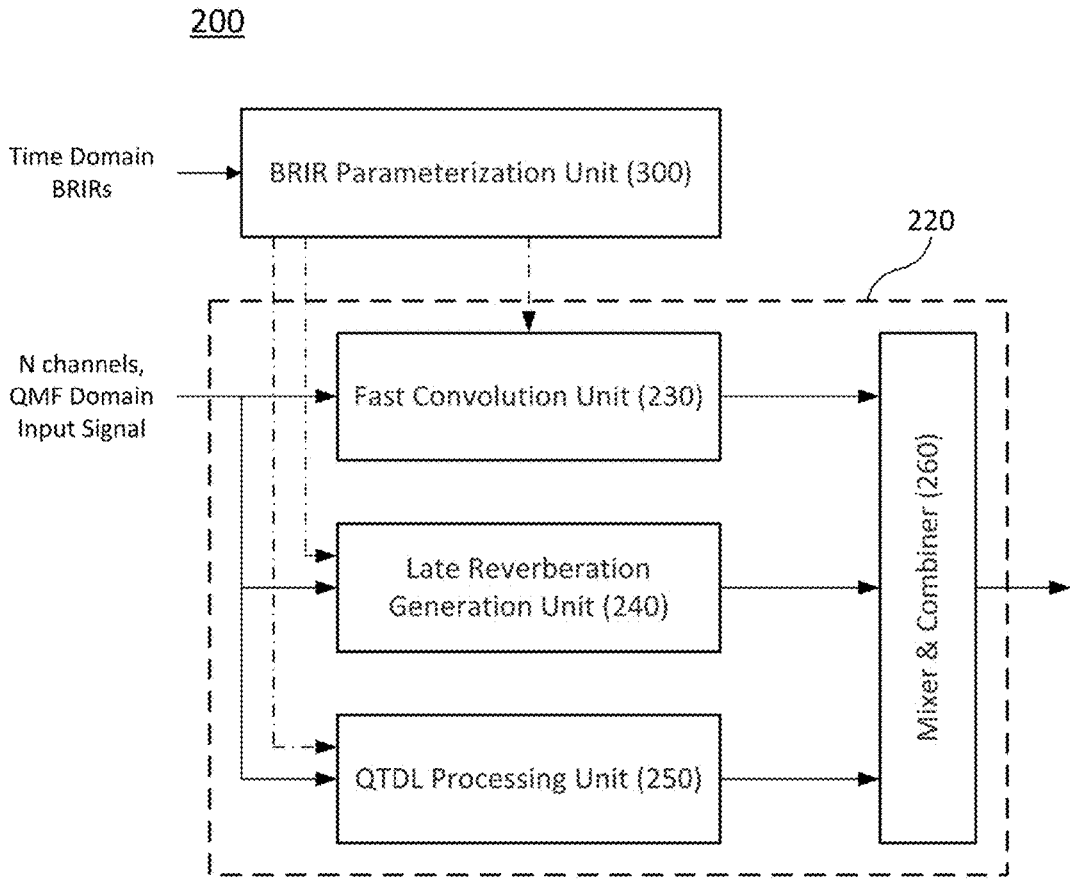
FIG. 2 is a block diagram illustrating each component of a binaural renderer according to an exemplary embodiment of the present invention.

FIG. 2 is a block diagram illustrating each component of a binaural renderer according to an exemplary embodiment of the present invention. As illustrated in FIG. 2, the binaural renderer 200 according to the exemplary embodiment of the present invention may include a BRIR parameterization unit 300, a fast convolution unit 230, a late reverberation generation unit 240, a QTDL processing unit 250, and a mixer & combiner 260.

The binaural renderer 200 generates a 3D audio headphone signal (that is, a 3D audio 2-channel signal) by performing binaural rendering of various types of input signals. In this case, the input signal may be an audio signal including at least one of the channel signals (that is, the loudspeaker channel signals), the object signals, and the HOA coefficient signals. According to another exemplary embodiment of the present invention, when the binaural renderer 200 includes a particular decoder, the input signal may be an encoded bitstream of the aforementioned audio signal. The binaural rendering converts the decoded input signal into the binaural downmix signal to make it possible to experience a surround sound at the time of hearing the corresponding binaural downmix signal through a headphone.

The binaural renderer 200 according to the exemplary embodiment of the present invention may perform the binaural rendering by using binaural room impulse response (BRIR) filter. When the binaural rendering using the BRIR is generalized, the binaural rendering is M-to-O processing for acquiring O output signals for the multi-channel input signals having M channels. Binaural filtering may be regarded as filtering using filter coefficients corresponding to each input channel and each output channel during such a process. To this end, various filter sets representing transfer functions up to locations of left and right ears from a speaker location of each channel signal may be used. A transfer function measured in a general listening room, that is, a reverberant space among the transfer functions is referred to as the binaural room impulse response (BRIR). On the contrary, a transfer function measured in an anechoic room so as not to be influenced by the reproduction space is referred to as a head related impulse response (HRIR), and a transfer function therefor is referred to as a head related transfer function (HRTF). Accordingly, differently from the HRTF, the BRIR contains information of the reproduction space as well as directional information. According to an exemplary embodiment, the BRIR may be substituted by using the HRTF and an artificial reverberator. In the specification, the binaural rendering using the BRIR is described, but the present invention is not limited thereto, and the present invention may be applied even to the binaural rendering using various types of FIR filters including HRIR and HRTF by a similar or a corresponding method. Furthermore, the present invention can be applied to various forms of filterings for input signals as well as the binaural rendering for the audio signals.

In the present invention, the apparatus for processing an audio signal may indicate the binaural renderer 200 or the binaural rendering unit 220, which is illustrated in FIG. 2, as a narrow meaning. However, in the present invention, the apparatus for processing an audio signal may indicate the audio signal decoder of FIG. 1, which includes the binaural renderer, as a broad meaning. Further, hereinafter, in the specification, an exemplary embodiment of the multi-channel input signals will be primarily described, but unless otherwise described, a channel, multi-channels, and the multi-channel input signals may be used as concepts including an object, multi-objects, and the multi-object input signals, respectively. Moreover, the multi-channel input signals may also be used as a concept including an HOA decoded and rendered signal.

According to the exemplary embodiment of the present invention, the binaural renderer 200 may perform the binaural rendering of the input signal in the QMF domain. That is to say, the binaural renderer 200 may receive signals of multi-channels (N channels) of the QMF domain and perform the binaural rendering for the signals of the multi-channels by using a BRIR subband filter of the QMF domain. When a k-th subband signal of an i-th channel, which passed through a QMF analysis filter bank, is represented by $x_{k,i}(l)$ and a time index in a subband domain is represented by 1, the binaural rendering in the QMF domain may be expressed by an equation given below.

$$y_k^m(l) = \sum_i x_{k,i}(l) * b_{k,i}^m(l) \quad \text{[Equation 1]}$$

Herein, m is L (left) or R (right), and $b_{k,i}^m(l)$ is obtained by converting the time domain BRIR filter into the subband filter of the QMF domain.

That is, the binaural rendering may be performed by a method that divides the channel signals or the object signals of the QMF domain into a plurality of subband signals and convolutes the respective subband signals with BRIR subband filters corresponding thereto, and thereafter, sums up the respective subband signals convoluted with the BRIR subband filters.

The BRIR parameterization unit 300 converts and edits BRIR filter coefficients for the binaural rendering in the QMF domain and generates various parameters. First, the BRIR parameterization unit 300 receives time domain BRIR filter coefficients for multi-channels or multi-objects, and converts the received time domain BRIR filter coefficients into QMF domain BRIR filter coefficients. In this case, the QMF domain BRIR filter coefficients include a plurality of subband filter coefficients corresponding to a plurality of frequency bands, respectively. In the present invention, the subband filter coefficients indicate each BRIR filter coefficients of a QMF-converted subband domain. In the specification, the subband filter coefficients may be designated as the BRIR subband filter coefficients. The BRIR parameterization unit 300 may edit each of the plurality of BRIR subband filter coefficients of the QMF domain and transfer the edited subband filter coefficients to the fast convolution unit 230, and the like. According to the exemplary embodiment of the present invention, the BRIR parameterization unit 300 may be included as a component of the binaural renderer 200 and, otherwise provided as a separate apparatus. According to an exemplary embodiment, a component including the fast convolution unit 230, the late reverberation generation unit 240, the QTDL processing unit 250, and the mixer & combiner 260, except for the BRIR parameterization unit 300, may be classified into a binaural rendering unit 220.

According to an exemplary embodiment, the BRIR parameterization unit 300 may receive BRIR filter coefficients corresponding to at least one location of a virtual reproduction space as an input. Each location of the virtual reproduction space may correspond to each speaker location of a multi-channel system. According to an exemplary embodiment, each of the BRIR filter coefficients received by the BRIR parameterization unit 300 may directly match each channel or each object of the input signal of the binaural renderer 200. On the contrary, according to another exemplary embodiment of the present invention, each of the received BRIR filter coefficients may have an independent configuration from the input signal of the binaural renderer 200. That is, at least a part of the BRIR filter coefficients received by the BRIR parameterization unit 300 may not directly match the input signal of the binaural renderer 200, and the number of received BRIR filter coefficients may be smaller or larger than the total number of channels and/or objects of the input signal.

The BRIR parameterization unit 300 may additionally receive control parameter information and generate a parameter for the binaural rendering based on the received control parameter information. The control parameter information may include a complexity-quality control parameter, and the like as described in an exemplary embodiment described below and be used as a threshold for various parameterization processes of the BRIR parameterization unit 300. The BRIR parameterization unit 300 generates a binaural rendering parameter based on the input value and transfers the generated binaural rendering parameter to the binaural rendering unit 220. When the input BRIR filter coefficients or the control parameter information is to be changed, the BRIR parameterization unit 300 may recalculate the binaural rendering parameter and transfer the recalculated binaural rendering parameter to the binaural rendering unit.

According to the exemplary embodiment of the present invention, the BRIR parameterization unit 300 converts and edits the BRIR filter coefficients corresponding to each channel or each object of the input signal of the binaural renderer 200 to transfer the converted and edited BRIR filter coefficients to the binaural rendering unit 220. The corresponding BRIR filter coefficients may be a matching BRIR or a fallback BRIR selected from BRIR filter set for each channel or each object. The BRIR matching may be determined whether BRIR filter coefficients targeting the location of each channel or each object are present in the virtual reproduction space. In this case, positional information of each channel (or object) may be obtained from an input parameter which signals the channel arrangement. When the BRIR filter coefficients targeting at least one of the locations of the respective channels or the respective objects of the input signal are present, the BRIR filter coefficients may be the matching BRIR of the input signal. However, when the BRIR filter coefficients targeting the location of a specific channel or object is not present, the BRIR parameterization unit 300 may provide BRIR filter coefficients, which target a location most similar to the corresponding channel or object, as the fallback BRIR for the corresponding channel or object.

First, when BRIR filter coefficients having altitude and azimuth deviations within a predetermined range from a desired position (a specific channel or object) are present in the BRIR filter set, the corresponding BRIR filter coefficients may be selected. In other words, BRIR filter coefficients having the same altitude as and an azimuth deviation within +/−20 from the desired position may be selected. When BRIR filter coefficients corresponding thereto are not present, BRIR filter coefficients having a minimum geometric distance from the desired position in a BRIR filter set may be selected. That is, BRIR filter coefficients that minimize a geometric distance between the position of the corresponding BRIR and the desired position may be selected. Herein, the position of the BRIR represents a position of the speaker corresponding to the relevant BRIR filter coefficients. Further, the geometric distance between both positions may be defined as a value obtained by aggregating an absolute value of an altitude deviation and an absolute value of an azimuth deviation between both positions. Meanwhile, according to the exemplary embodiment, by a method for interpolating the BRIR filter coefficients, the position of the BRIR filter set may be matched up with the desired position. In this case, the interpolated BRIR filter coefficients may be regarded as a part of the BRIR filter set. That is, in this case, it may be implemented that the BRIR filter coefficients are always present at the desired position.

The BRIR filter coefficients corresponding to each channel or each object of the input signal may be transferred through separate vector information $m_{conv}$. The vector information $m_{conv}$ indicates the BRIR filter coefficients corresponding to each channel or object of the input signal in the BRIR filter set. For example, when BRIR filter coefficients having positional information matching with positional information of a specific channel of the input signal are present in the BRIR filter set, the vector information $m_{conv}$ indicates the relevant BRIR filter coefficients as BRIR filter coefficients corresponding to the specific channel. However, the vector information $m_{conv}$ indicates fallback BRIR filter coefficients having a minimum geometric distance from positional information of the specific channel as the BRIR filter coefficients corresponding to the specific channel when the BRIR filter coefficients having positional information matching positional information of the specific channel of the input signal are not present in the BRIR filter set. Accordingly, the parameterization unit 300 may determine the BRIR filter coefficients corresponding to each channel or object of the input audio signal in the entire BRIR filter set by using the vector information $m_{conv}$.

Meanwhile, according to another exemplary embodiment of the present invention, the BRIR parameterization unit 300 converts and edits all of the received BRIR filter coefficients to transfer the converted and edited BRIR filter coefficients to the binaural rendering unit 220. In this case, a selection procedure of the BRIR filter coefficients (alternatively, the edited BRIR filter coefficients) corresponding to each channel or each object of the input signal may be performed by the binaural rendering unit 220.

When the BRIR parameterization unit 300 is constituted by a device apart from the binaural rendering unit 220, the binaural rendering parameter generated by the BRIR parameterization unit 300 may be transmitted to the binaural rendering unit 220 as a bitstream. The binaural rendering unit 220 may obtain the binaural rendering parameter by decoding the received bitstream. In this case, the transmitted binaural rendering parameter includes various parameters required for processing in each sub-unit of the binaural rendering unit 220 and may include the converted and edited BRIR filter coefficients, or the original BRIR filter coefficients.

The binaural rendering unit 220 includes a fast convolution unit 230, a late reverberation generation unit 240, and a QTDL processing unit 250 and receives multi-audio signals including multi-channel and/or multi-object signals. In the specification, the input signal including the multi-channel and/or multi-object signals will be referred to as the multi-audio signals. FIG. 2 illustrates that the binaural rendering unit 220 receives the multi-channel signals of the QMF domain according to an exemplary embodiment, but the input signal of the binaural rendering unit 220 may further include time domain multi-channel signals and time domain multi-object signals. Further, when the binaural rendering unit 220 additionally includes a particular decoder, the input signal may be an encoded bitstream of the multi-audio signals. Moreover, in the specification, the present invention is described based on a case of performing BRIR rendering of the multi-audio signals, but the present invention is not limited thereto. That is, features provided by the present invention may be applied to not only the BRIR but also other types of rendering filters and applied to not only the multi-audio signals but also an audio signal of a single channel or single object.

The fast convolution unit 230 performs a fast convolution between the input signal and the BRIR filter to process direct sound and early reflections sound for the input signal. To this end, the fast convolution unit 230 may perform the fast convolution by using a truncated BRIR. The truncated BRIR includes a plurality of subband filter coefficients truncated dependently on each subband frequency and is generated by the BRIR parameterization unit 300. In this case, the length of each of the truncated subband filter coefficients is determined dependently on a frequency of the corresponding subband. The fast convolution unit 230 may perform variable order filtering in a frequency domain by using the truncated subband filter coefficients having different lengths according to the subband. That is, the fast convolution may be performed between QMF domain subband signals and the truncated subband filters of the QMF domain corresponding thereto for each frequency band. The truncated subband filter corresponding to each subband signal may be identified by the vector information $m_{conv}$ given above.

The late reverberation generation unit 240 generates a late reverberation signal for the input signal. The late reverberation signal represents an output signal which follows the direct sound and the early reflections sound generated by the fast convolution unit 230. The late reverberation generation unit 240 may process the input signal based on reverberation time information determined by each of the subband filter coefficients transferred from the BRIR parameterization unit 300. According to the exemplary embodiment of the present invention, the late reverberation generation unit 240 may generate a mono or stereo downmix signal for an input audio signal and perform late reverberation processing of the generated downmix signal.

The QMF domain tapped delay line (QTDL) processing unit 250 processes signals in high-frequency bands among the input audio signals. The QTDL processing unit 250 receives at least one parameter (QTDL parameter), which corresponds to each subband signal in the high-frequency bands, from the BRIR parameterization unit 300 and performs tap-delay line filtering in the QMF domain by using the received parameter. The parameter corresponding to each subband signal may be identified by the vector information $m_{conv}$ given above. According to the exemplary embodiment of the present invention, the binaural renderer 200 separates the input audio signals into low-frequency band signals and high-frequency band signals based on a predetermined constant or a predetermined frequency band, and the low-frequency band signals may be processed by the fast convolution unit 230 and the late reverberation generation unit 240, and the high frequency band signals may be processed by the QTDL processing unit 250, respectively.

Each of the fast convolution unit 230, the late reverberation generation unit 240, and the QTDL processing unit 250 outputs the 2-channel QMF domain subband signal. The mixer & combiner 260 combines and mixes the output signals of the fast convolution unit 230, the output signal of the late reverberation generation unit 240, and the output signal of the QTDL processing unit 250 for each subband. In this case, the combination of the output signals is performed separately for each of left and right output signals of 2 channels. The binaural renderer 200 performs QMF synthesis to the combined output signals to generate a final binaural output audio signal in the time domain.

<Variable Order Filtering in Frequency-Domain (VOFF)>

Figure 3:
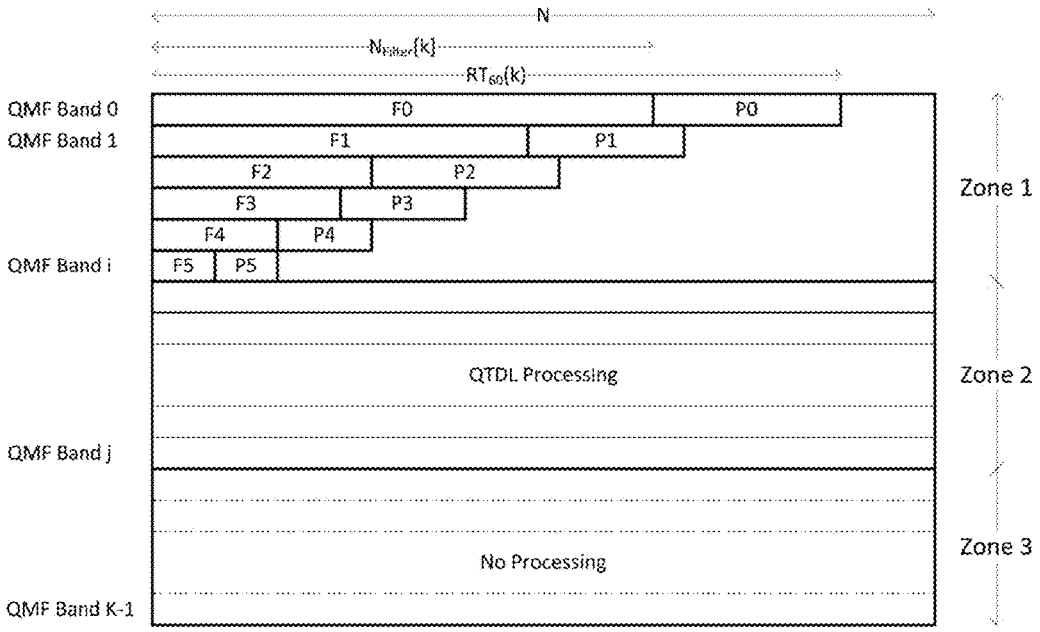
FIG. 3 is a diagram illustrating a method for generating a filter for binaural rendering according to an exemplary embodiment of the present invention.

FIG. 3 is a diagram illustrating a filter generating method for binaural rendering according to an exemplary embodiment of the present invention. An FIR filter converted into a plurality of subband filters may be used for binaural rendering in a QMF domain. According to the exemplary embodiment of the present invention, the fast convolution unit of the binaural renderer may perform variable order filtering in the QMF domain by using the truncated subband filters having different lengths according to each subband frequency.

In FIG. 3, Fk represents the truncated subband filter used for the fast convolution in order to process direct sound and early reflection sound of QMF subband k. Further, Pk represents a filter used for late reverberation generation of QMF subband k. In this case, the truncated subband filter Fk may be a front filter truncated from an original subband filter and be also designated as a front subband filter. Further, Pk may be a rear filter after truncation of the original subband filter and be also designated as a rear subband filter. The QMF domain has a total of K subbands and according to the exemplary embodiment, 64 subbands may be used. Further, N represents a length (tab number) of the original subband filter and $N_{Filter}[k]$ represents a length of the front subband filter of subband k. In this case, the length $N_{Filter}[k]$ represents the number of tabs in the QMF domain which is down-sampled.

In the case of rendering using the BRIR filter, a filter order (that is, filter length) for each subband may be determined based on parameters extracted from an original BRIR filter, that is, reverberation time (RT) information for each subband filter, an energy decay curve (EDC) value, energy decay time information, and the like. A reverberation time may vary depending on the frequency due to acoustic characteristics in which decay in air and a sound-absorption degree depending on materials of a wall and a ceiling vary for each frequency. In general, a signal having a lower frequency has a longer reverberation time. Since the long reverberation time means that more information remains in the rear part of the FIR filter, it is preferable to truncate the corresponding filter long in normally transferring reverberation information. Accordingly, the length of each truncated subband filter Fk of the present invention is determined based at least in part on the characteristic information (for example, reverberation time information) extracted from the corresponding subband filter.

According to an embodiment, the length of the truncated subband filter Fk may be determined based on additional information obtained by the apparatus for processing an audio signal, that is, complexity, a complexity level (profile), or required quality information of the decoder. The complexity may be determined according to a hardware resource of the apparatus for processing an audio signal or a value directly input by the user. The quality may be determined according to a request of the user or determined with reference to a value transmitted through the bitstream or other information included in the bitstream. Further, the quality may also be determined according to a value obtained by estimating the quality of the transmitted audio signal, that is to say, as a bit rate is higher, the quality may be regarded as a higher quality. In this case, the length of each truncated subband filter may proportionally increase according to the complexity and the quality and may vary with different ratios for each band. Further, in order to acquire an additional gain by high-speed processing such as FFT, and the like, the length of each truncated subband filter may be determined as a corresponding size unit, for example to say, a multiple of the power of 2. On the contrary, when the determined length of the truncated subband filter is longer than a total length of an actual subband filter, the length of the truncated subband filter may be adjusted to the length of the actual subband filter.

The BRIR parameterization unit according to the embodiment of the present invention generates the truncated subband filter coefficients corresponding to the respective lengths of the truncated subband filters determined according to the aforementioned exemplary embodiment, and transfers the generated truncated subband filter coefficients to the fast convolution unit. The fast convolution unit performs the variable order filtering in frequency domain (VOFF processing) of each subband signal of the multi-audio signals by using the truncated subband filter coefficients. That is, in respect to a first subband and a second subband which are different frequency bands with each other, the fast convolution unit generates a first subband binaural signal by applying a first truncated subband filter coefficients to the first subband signal and generates a second subband binaural signal by applying a second truncated subband filter coefficients to the second subband signal. In this case, each of the first truncated subband filter coefficients and the second truncated subband filter coefficients may have different lengths independently and is obtained from the same proto-type filter in the time domain. That is, since a single filter in the time domain is converted into a plurality of QMF subband filters and the lengths of the filters corresponding to the respective subbands vary, each of the truncated subband filters is obtained from a single proto-type filter.

Meanwhile, according to an exemplary embodiment of the present invention, the plurality of subband filters, which are QMF-converted, may be classified into the plurality of groups, and different processing may be applied for each of the classified groups. For example, the plurality of subbands may be classified into a first subband group Zone 1 having low frequencies and a second subband group Zone 2 having high frequencies based on a predetermined frequency band (QMF band i). In this case, the VOFF processing may be performed with respect to input subband signals of the first subband group, and QTDL processing to be described below may be performed with respect to input subband signals of the second subband group.

Accordingly, the BRIR parameterization unit generates the truncated subband filter (the front subband filter) coefficients for each subband of the first subband group and transfers the front subband filter coefficients to the fast convolution unit. The fast convolution unit performs the VOFF processing of the subband signals of the first subband group by using the received front subband filter coefficients. According to an exemplary embodiment, a late reverberation proceesing of the subband signals of the first subband group may be additionally performed by the late reverberation generation unit. Further, the BRIR parameterization unit obtains at least one parameter from each of the subband filter coefficients of the second subband group and transfers the obtained parameter to the QTDL processing unit. The QTDL processing unit performs tap-delay line filtering of each subband signal of the second subband group as described below by using the obtained parameter. According to the exemplary embodiment of the present invention, the predetermined frequency (QMF band i) for distinguishing the first subband group and the second subband group may be determined based on a predetermined constant value or determined according to a bitstream characteristic of the transmitted audio input signal. For example, in the case of the audio signal using the SBR, the second subband group may be set to correspond to an SBR bands.

According to another exemplary embodiment of the present invention, the plurality of subbands may be classified into three subband groups based on a predetermined first frequency band (QMF band i) and a second frequency band (QMF band j) as illustrated in FIG. 3. That is, the plurality of subbands may be classified into a first subband group Zone 1 which is a low-frequency zone equal to or lower than the first frequency band, a second subband group Zone 2 which is an intermediate-frequency zone higher than the first frequency band and equal to or lower than the second frequency band, and a third subband group Zone 3 which is a high-frequency zone higher than the second frequency band. For example, when a total of 64 QMF subbands (subband indexes 0 to 63) are divided into the 3 subband groups, the first subband group may include a total of 32 subbands having indexes 0 to 31, the second subband group may include a total of 16 subbands having indexes 32 to 47, and the third subband group may include subbands having residual indexes 48 to 63. Herein, the subband index has a lower value as a subband frequency becomes lower.

According to the exemplary embodiment of the present invention, the binaural rendering may be performed only with respect to subband signals of the first subband group and the second subband groups. That is, as described above, the VOFF processing and the late reverberation processing may be performed with respect to the subband signals of the first subband group and the QTDL processing may be performed with respect to the subband signals of the second subband group. Further, the binaural rendering may not be performed with respect to the subband signals of the third subband group. Meanwhile, information (kMax=48) of the number of frequency bands to perform the binaural rendering and information (kConv=32) of the number of frequency bands to perform the convolution may be predetermined values or be determined by the BRIR parameterization unit to be transferred to the binaural rendering unit. In this case, a first frequency band (QMF band i) is set as a subband of an index kConv−1 and a second frequency band (QMF band j) is set as a subband of an index kMax−1. Meanwhile, the values of the information (kMax) of the number of frequency bands and the information (kConv) of the number of frequency bands to perform the convolution may vary by a sampling frequency of an original BRIR input, a sampling frequency of an input audio signal, and the like.

Meanwhile, according to the exemplary embodiment of FIG. 3, the length of the rear subband filter Pk may also be determined based on the parameters extracted from the original subband filter as well as the front subband filter Fk. That is, the lengths of the front subband filter and the rear subband filter of each subband are determined based at least in part on the characteristic information extracted in the corresponding subband filter. For example, the length of the front subband filter may be determined based on first reverberation time information of the corresponding subband filter, and the length of the rear subband filter may be determined based on second reverberation time information. That is, the front subband filter may be a filter at a truncated front part based on the first reverberation time information in the original subband filter, and the rear subband filter may be a filter at a rear part corresponding to a zone between a first reverberation time and a second reverberation time as a zone which follows the front subband filter. According to an exemplary embodiment, the first reverberation time information may be RT20, and the second reverberation time information may be RT60, but the present invention is not limited thereto.

A part where an early reflections sound part is switched to a late reverberation sound part is present within a second reverberation time. That is, a point is present, where a zone having a deterministic characteristic is switched to a zone having a stochastic characteristic, and the point is called a mixing time in terms of the BRIR of the entire band. In the case of a zone before the mixing time, information providing directionality for each location is primarily present, and this is unique for each channel. On the contrary, since the late reverberation part has a common feature for each channel, it may be efficient to process a plurality of channels at once. Accordingly, the mixing time for each subband is estimated to perform the fast convolution through the VOFF processing before the mixing time and perform processing in which a common characteristic for each channel is reflected through the late reverberation processing after the mixing time.

However, an error may occur by a bias from a perceptual viewpoint at the time of estimating the mixing time. Therefore, performing the fast convolution by maximizing the length of the VOFF processing part is more excellent from a quality viewpoint than separately processing the VOFF processing part and the late reverberation part based on the corresponding boundary by estimating an accurate mixing time. Therefore, the length of the VOFF processing part, that is, the length of the front subband filter may be longer or shorter than the length corresponding to the mixing time according to complexity-quality control.

Moreover, in order to reduce the length of each subband filter, in addition to the aforementioned truncation method, when a frequency response of a specific subband is monotonic, a modeling of reducing the filter of the corresponding subband to a low order is available. As a representative method, there is FIR filter modeling using frequency sampling, and a filter minimized from a least square viewpoint may be designed.

<QTDL Processing of High-Frequency Bands>

Figure 4:
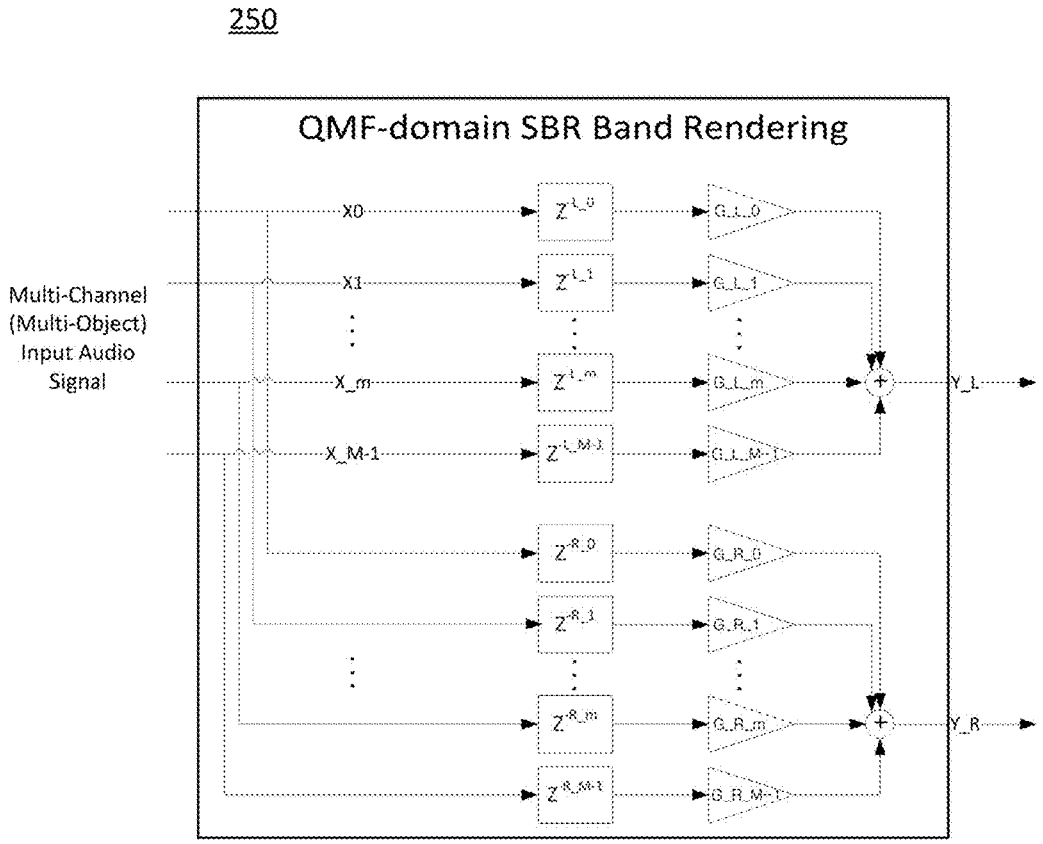
FIG. 4 is a diagram illustrating a detailed QTDL processing according to an exemplary embodiment of the present invention.

FIG. 4 is a diagram more specifically illustrating QTDL processing according to the exemplary embodiment of the present invention. According to the exemplary embodiment of FIG. 4, the QTDL processing unit 250 performs subband-specific filtering of multi-channel input signals X0, X1, . . . , X_M−1 by using the one-tap-delay line filter. In this case, it is assumed that the multi-channel input signals are received as the subband signals of the QMF domain. Therefore, in the exemplary embodiment of FIG. 4, the one-tap-delay line filter may perform processing for each QMF subband. The one-tap-delay line filter performs the convolution by using only one tap with respect to each channel signal. In this case, the used tap may be determined based on the parameter directly extracted from the BRIR subband filter coefficients corresponding to the relevant subband signal. The parameter includes delay information for the tap to be used in the one-tap-delay line filter and gain information corresponding thereto.

In FIG. 4, L_0, L_1, . . . L_M−1 represent delays for the BRIRs with respect to M channels (input channels)-left ear (left output channel), respectively, and R_0, R_1, . . . , R_M−1 represent delays for the BRIRs with respect to M channels (input channels)-right ear (right output channel), respectively. In this case, the delay information represents positional information for the maximum peak in the order of an absolution value, the value of a real part, or the value of an imaginary part among the BRIR subband filter coefficients. Further, in FIG. 4, G_L_0, G_L_1, . . . , G_L_M−1 represent gains corresponding to respective delay information of the left channel and G_R_0, G_R_1, . . . , G_R_M−1 represent gains corresponding to the respective delay information of the right channels, respectively. Each gain information may be determined based on the total power of the corresponding BRIR subband filter coefficients, the size of the peak corresponding to the delay information, and the like. In this case, as the gain information, the weighted value of the corresponding peak after energy compensation for whole subband filter coefficients may be used as well as the corresponding peak value itself in the subband filter coefficients. The gain information is obtained by using both the real-number of the weighted value and the imaginary-number of the weighted value for the corresponding peak.

Meanwhile, the QTDL processing may be performed only with respect to input signals of high-frequency bands, which are classified based on the predetermined constant or the predetermined frequency band, as described above. When the spectral band replication (SBR) is applied to the input audio signal, the high-frequency bands may correspond to the SBR bands. The spectral band replication (SBR) used for efficient encoding of the high-frequency bands is a tool for securing a bandwidth as large as an original signal by re-extending a bandwidth which is narrowed by throwing out signals of the high-frequency bands in low-bit rate encoding. In this case, the high-frequency bands are generated by using information of low-frequency bands, which are encoded and transmitted, and additional information of the high-frequency band signals transmitted by the encoder. However, distortion may occur in a high-frequency component generated by using the SBR due to generation of inaccurate harmonics. Further, the SBR bands are the high-frequency bands, and as described above, reverberation times of the corresponding frequency bands are very short. That is, the BRIR subband filters of the SBR bands have small effective information and a high decay rate. Accordingly, in BRIR rendering for the high-frequency bands corresponding to the SBR bands, performing the rendering by using a small number of effective taps may be still more effective in terms of a computational complexity to the sound quality than performing the convolution.

The plurality of channel signals filtered by the one-tap-delay line filter is aggregated to the 2-channel left and right output signals Y_L and Y_R for each subband. Meanwhile, the parameter (QTDL parameter) used in each one-tap-delay line filter of the QTDL processing unit 250 may be stored in the memory during an initialization process for the binaural rendering and the QTDL processing may be performed without an additional operation for extracting the parameter.

<BRIR Parameterization in Detail>

Figure 5:
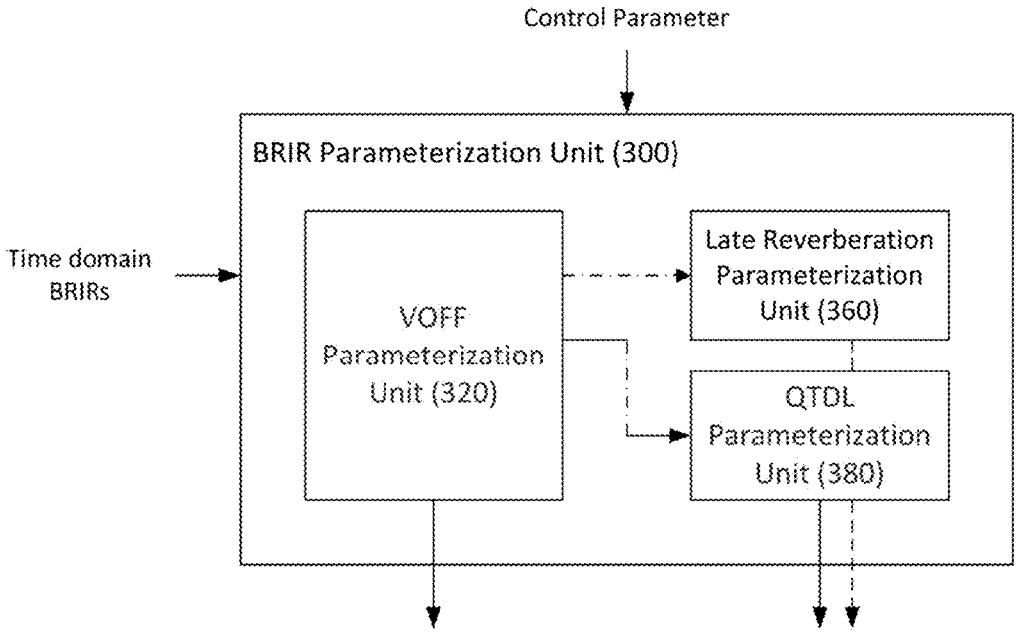
FIG. 5 is a block diagram illustrating respective components of a BRIR parameterization unit of an embodiment of the present invention.

FIG. 5 is a block diagram illustrating respective components of a BRIR parameterization unit according to an exemplary embodiment of the present invention. As illustrated in FIG. 14, the BRIR parameterization unit 300 may include an VOFF parameterization unit 320, a late reverberation parameterization unit 360, and a QTDL parameterization unit 380. The BRIR parameterization unit 300 receives a BRIR filter set of the time domain as an input and each sub-unit of the BRIR parameterization unit 300 generate various parameters for the binaural rendering by using the received BRIR filter set. According to the exemplary embodiment, the BRIR parameterization unit 300 may additionally receive the control parameter and generate the parameter based on the receive control parameter.

First, the VOFF parameterization unit 320 generates truncated subband filter coefficients required for variable order filtering in frequency domain (VOFF) and the resulting auxiliary parameters. For example, the VOFF parameterization unit 320 calculates frequency band-specific reverberation time information, filter order information, and the like which are used for generating the truncated subband filter coefficients and determines the size of a block for performing block-wise fast Fourier transform for the truncated subband filter coefficients. Some parameters generated by the VOFF parameterization unit 320 may be transmitted to the late reverberation parameterization unit 360 and the QTDL parameterization unit 380. In this case, the transferred parameters are not limited to a final output value of the VOFF parameterization unit 320 and may include a parameter generated in the meantime according to processing of the VOFF parameterization unit 320, that is, the truncated BRIR filter coefficients of the time domain, and the like.

The late reverberation parameterization unit 360 generates a parameter required for late reverberation generation. For example, the late reverberation parameterization unit 360 may generate the downmix subband filter coefficients, the IC (Interaural Coherence) value, and the like. Further, the QTDL parameterization unit 380 generates a parameter (QTDL parameter) for QTDL processing. In more detail, the QTDL parameterization unit 380 receives the subband filter coefficients from the late reverberation parameterization unit 320 and generates delay information and gain information in each subband by using the received subband filter coefficients. In this case, the QTDL parameterization unit 380 may receive information kMax of the number of frequency bands for performing the binaural rendering and information kConv of the number of frequency bands for performing the convolution as the control parameters and generate the delay information and the gain information for each frequency band of a subband group having kMax and kConv as boundaries. According to the exemplary embodiment, the QTDL parameterization unit 380 may be provided as a component included in the VOFF parameterization unit 320.

The parameters generated in the VOFF parameterization unit 320, the late reverberation parameterization unit 360, and the QTDL parameterization unit 380, respectively are transmitted to the binaural rendering unit (not illustrated). According to the exemplary embodiment, the later reverberation parameterization unit 360 and the QTDL parameterization unit 380 may determine whether the parameters are generated according to whether the late reverberation processing and the QTDL processing are performed in the binaural rendering unit, respectively. When at least one of the late reverberation processing and the QTDL processing is not performed in the binaural rendering unit, the late reverberation parameterization unit 360 and the QTDL parameterization unit 380 corresponding thereto may not generate the parameters or not transmit the generated parameters to the binaural rendering unit.

Figure 6:
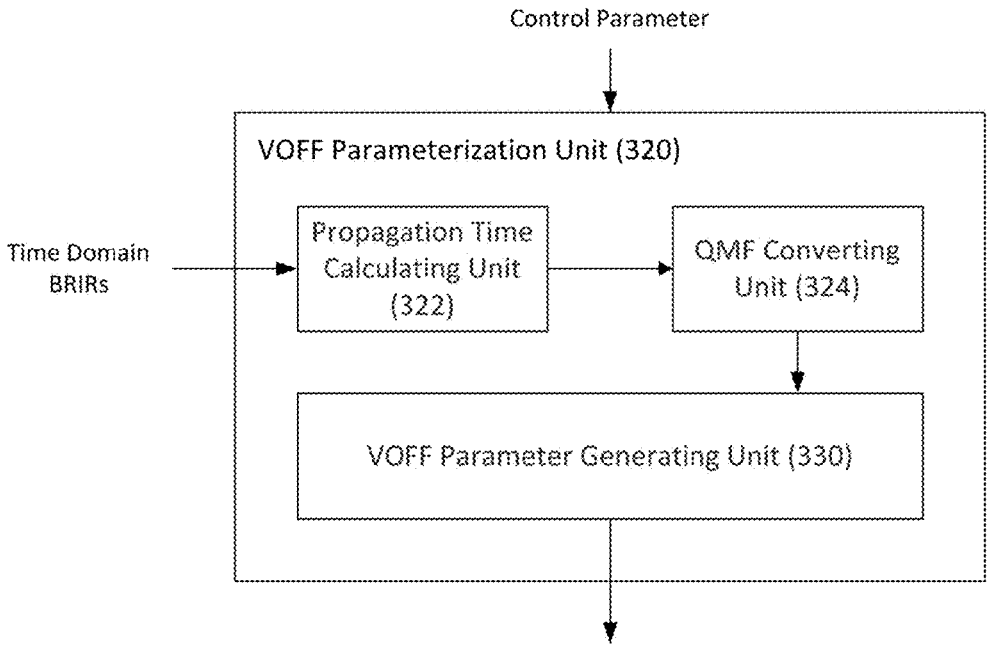
FIG. 6 is a block diagram illustrating respective components of a VOFF parameterization unit of an embodiment of the present invention.

FIG. 6 is a block diagram illustrating respective components of a VOFF parameterization unit of the present invention. As illustrated in FIG. 15, the VOFF parameterization unit 320 may include a propagation time calculating unit 322, a QMF converting unit 324, and an VOFF parameter generating unit 330. The VOFF parameterization unit 320 performs a process of generating the truncated subband filter coefficients for VOFF processing by using the received time domain BRIR filter coefficients.

First, the propagation time calculating unit 322 calculates propagation time information of the time domain BRIR filter coefficients and truncates the time domain BRIF filter coefficients based on the calculated propagation time information. Herein, the propagation time information represents a time from an initial sample to direct sound of the BRIR filter coefficients. The propagation time calculating unit 322 may truncate a part corresponding to the calculated propagation time from the time domain BRIR filter coefficients and remove the truncated part.

Various methods may be used for estimating the propagation time of the BRIR filter coefficients. According to the exemplary embodiment, the propagation time may be estimated based on first point information where an energy value larger than a threshold which is in proportion to a maximum peak value of the BRIR filter coefficients is shown. In this case, since all distances from respective channels of multi-channel inputs up to a listener are different from each other, the propagation time may vary for each channel. However, the truncating lengths of the propagation time of all channels need to be the same as each other in order to perform the convolution by using the BRIR filter coefficients in which the propagation time is truncated at the time of performing the binaural rendering and compensate a final signal in which the binaural rendering is performed with a delay. Further, when the truncating is performed by applying the same propagation time information to each channel, error occurrence probabilities in the individual channels may be reduced.

In order to calculate the propagation time information according to the exemplary embodiment of the present invention, frame energy E(k) for a frame wise index k may be first defined. When the time domain BRIR filter coefficient for an input channel index m, an left/right output channel index i, and a time slot index v of the time domain is $\tilde{h}_{i,m}^{v}$, the frame energy E(k) in a k-th frame may be calculated by an equation given below.

$$E(k) = \frac{1}{2N_{BRIR}} \sum_{m=1}^{N_{BRIR}} \sum_{i=0}^{1} \frac{1}{L_{frm}} \sum_{n=0}^{L_{frm}-1} \tilde{h}_{i,m}^{kN_{hop}+n} \quad \text{[Equation 2]}$$

Where, $N_{BRIR}$ represents the number of total filters of BRIR filter set, $N_{hop}$ represents a predetermined hop size, and $L_{frm}$ represents a frame size. That is, the frame energy E(k) may be calculated as an average value of the frame energy for each channel with respect to the same time interval.

The propagation time pt may be calculated through an equation given below by using the defined frame energy E(k).

$$pt = \frac{L_{frm}}{2} + N_{hop} * \min\left[\arg_k\left(\frac{E(k)}{\max(E)} > -60\text{ dB}\right)\right] \quad \text{[Equation 3]}$$

That is, the propagation time calculating unit 322 measures the frame energy by shifting a predetermined hop wise and identifies the first frame in which the frame energy is larger than a predetermined threshold. In this case, the propagation time may be determined as an intermediate point of the identified first frame. Meanwhile, in Equation 3, it is described that the threshold is set to a value which is lower than maximum frame energy by 60 dB, but the present invention is not limited thereto and the threshold may be set to a value which is in proportion to the maximum frame energy or a value which is different from the maximum frame energy by a predetermined value.

Meanwhile, the hop size $N_{hop}$ and the frame size $L_{frm}$ may vary based on whether the input BRIR filter coefficients are head related impulse response (HRIR) filter coefficients. In this case, information flag_HRIR indicating whether the input BRIR filter coefficients are the HRIR filter coefficients may be received from the outside or estimated by using the length of the time domain BRIR filter coefficients. In general, a boundary of an early reflection sound part and a late reverberation part is known as 80 ms. Therefore, when the length of the time domain BRIR filter coefficients is 80 ms or less, the corresponding BRIR filter coefficients are determined as the HRIR filter coefficients (flag_HRIR=1) and when the length of the time domain BRIR filter coefficients is more than 80 ms, it may be determined that the corresponding BRIR filter coefficients are not the HRIR filter coefficients (flag_HRIR=0). The hop size $N_{hop}$ and the frame size $L_{frm}$ when it is determined that the input BRIR filter coefficients are the HRIR filter coefficients (flag_HRIR=1) may be set to smaller values than those when it is determined that the corresponding BRIR filter coefficients are not the HRIR filter coefficients (flag_HRIR=0). For example, in the case of flag_HRIR=0, the hop size $N_{hop}$ and the frame size $L_{frm}$ may be set to 8 and 32 samples, respectively and in the case of flag_HRIR=1, the hop size $N_{hop}$ and the frame size $L_{frm}$ may be set to 1 and 8 sample(s), respectively.

According to the exemplary embodiment of the present invention, the propagation time calculating unit 322 may truncate the time domain BRIR filter coefficients based on the calculated propagation time information and transfer the truncated BRIR filter coefficients to the QMF converting unit 324. Herein, the truncated BRIR filter coefficients indicates remaining filter coefficients after truncating and removing the part corresponding to the propagation time from the original BRIR filter coefficients. The propagation time calculating unit 322 truncates the time domain BRIR filter coefficients for each input channel and each left/right output channel and transfers the truncated time domain BRIR filter coefficients to the QMF converting unit 324.

The QMF converting unit 324 performs conversion of the input BRIR filter coefficients between the time domain and the QMF domain. That is, the QMF converting unit 324 receives the truncated BRIR filter coefficients of the time domain and converts the received BRIR filter coefficients into a plurality of subband filter coefficients corresponding to a plurality of frequency bands, respectively. The converted subband filter coefficients are transferred to the VOFF parameter generating unit 330 and the VOFF parameter generating unit 330 generates the truncated subband filter coefficients by using the received subband filter coefficients. When the QMF domain BRIR filter coefficients instead of the time domain BRIR filter coefficients are received as the input of the VOFF parameterization unit 320, the received QMF domain BRIR filter coefficients may bypass the QMF converting unit 324. Further, according to another exemplary embodiment, when the input filter coefficients are the QMF domain BRIR filter coefficients, the QMF converting unit 324 may be omitted in the VOFF parameterization unit 320.

Figure 7:
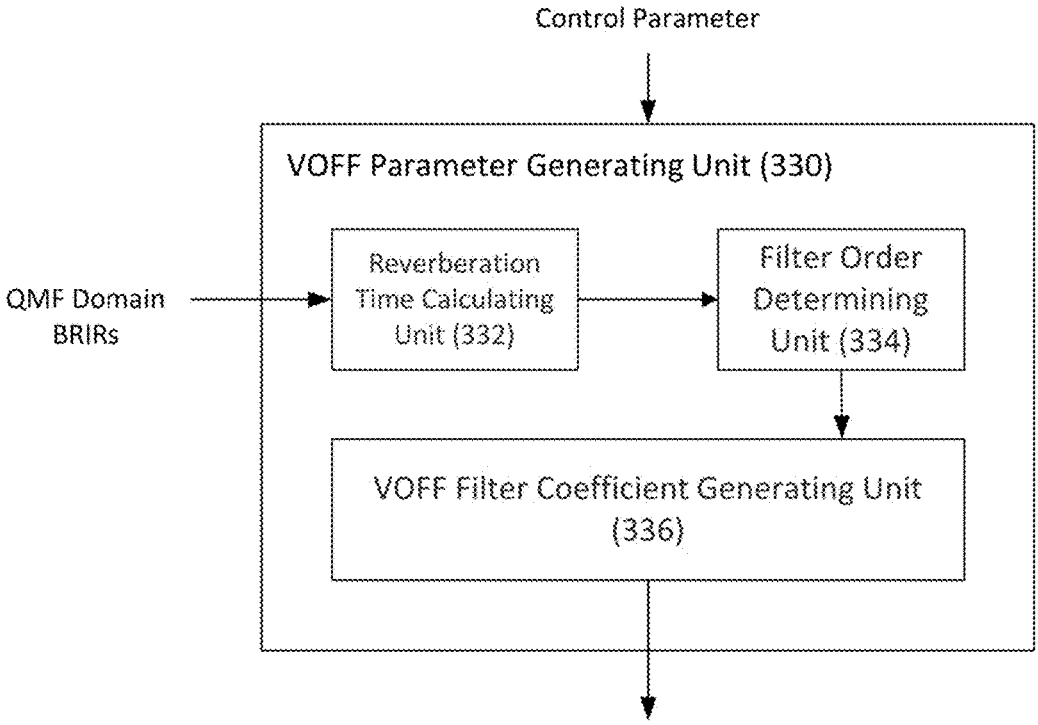
FIG. 7 is a block diagram illustrating a detailed configuration of a VOFF parameter generating unit of an embodiment of the present invention.

FIG. 7 is a block diagram illustrating a detailed configuration of the VOFF parameter generating unit of FIG. 6. As illustrated in FIG. 7, the VOFF parameter generating unit 330 may include a reverberation time calculating unit 332, a filter order determining unit 334, and a VOFF filter coefficient generating unit 336. The VOFF parameter generating unit 330 may receive the QMF domain subband filter coefficients from the QMF converting unit 324 of FIG. 6. Further, the control parameters including the information kMax of the number of frequency bands for performing the binaural rendering, the information Kconv of the number of frequency bands performing the convolution, predetermined maximum FFT size information, and the like may be input into the VOFF parameter generating unit 330.

First, the reverberation time calculating unit 332 obtains the reverberation time information by using the received subband filter coefficients. The obtained reverberation time information may be transferred to the filter order determining unit 334 and used for determining the filter order of the corresponding subband. Meanwhile, since a bias or a deviation may be present in the reverberation time information according to a measurement environment, a unified value may be used by using a mutual relationship with another channel. According to the exemplary embodiment, the reverberation time calculating unit 332 generates average reverberation time information of each subband and transfers the generated average reverberation time information to the filter order determining unit 334. When the reverberation time information of the subband filter coefficients for the input channel index m, the left/right output channel index i, and the subband index k is RT(k, m, i), the average reverberation time information $RT^k$ of the subband k may be calculated through an equation given below.

$$RT^k = \frac{1}{2N_{BRIR}} \sum_{i=0}^{1} \sum_{m=0}^{N_{BRIR}-1} RT(k, m, i) \quad \text{[Equation 4]}$$

Where, $N_{BRIR}$ represents the number of total filters of BRIR filter set.

That is, the reverberation time calculating unit 332 extracts the reverberation time information RT(k, m, i) from each subband filter coefficients corresponding to the multi-channel input and obtains an average value (that is, the average reverberation time information $RT^k$) of the reverberation time information RT(k, m, i) of each channel extracted with respect to the same subband. The obtained average reverberation time information $RT^k$ may be transferred to the filter order determining unit 334 and the filter order determining unit 334 may determine a single filter order applied to the corresponding subband by using the transferred average reverberation time information $RT^k$. In this case, the obtained average reverberation time information may include RT20 and according to the exemplary embodiment, other reverberation time information, that is to say, RT30, RT60, and the like may be obtained as well. Meanwhile, according to another exemplary embodiment of the present invention, the reverberation time calculating unit 332 may transfer a maximum value and/or a minimum value of the reverberation time information of each channel extracted with respect to the same subband to the filter order determining unit 334 as representative reverberation time information of the corresponding subband.

Next, the filter order determining unit 334 determines the filter order of the corresponding subband based on the obtained reverberation time information. As described above, the reverberation time information obtained by the filter order determining unit 334 may be the average reverberation time information of the corresponding subband and according to exemplary embodiment, the representative reverberation time information with the maximum value and/or the minimum value of the reverberation time information of each channel may be obtained instead. The filter order may be used for determining the length of the truncated subband filter coefficients for the binaural rendering of the corresponding subband.

When the average reverberation time information in the subband k is $RT^k$, the filter order information $N_{Filter}[k]$ of the corresponding subband may be obtained through an equation given below.

$$N_{Filter}[k] = 2^{\lfloor \log_2 RT^k + 0.5 \rfloor} \quad \text{[Equation 5]}$$

That is, the filter order information may be determined as a value of power of 2 using a log-scaled approximated integer value of the average reverberation time information of the corresponding subband as an index. In other words, the filter order information may be determined as a value of power of 2 using a round off value, a round up value, or a round down value of the average reverberation time information of the corresponding subband in the log scale as the index. When an original length of the corresponding subband filter coefficients, that is, a length up to the last time slot $n_{end}$ is smaller than the value determined in Equation 5, the filter order information may be substituted with the original length value $n_{end}$ of the subband filter coefficients. That is, the filter order information may be determined as a smaller value of a reference truncation length determined by Equation 5 and the original length of the subband filter coefficients.

Meanwhile, the decay of the energy depending on the frequency may be linearly approximated in the log scale. Therefore, when a curve fitting method is used, optimized filter order information of each subband may be determined. According to the exemplary embodiment of the present invention, the filter order determining unit 334 may obtain the filter order information by using a polynomial curve fitting method. To this end, the filter order determining unit 334 may obtain at least one coefficient for curve fitting of the average reverberation time information. For example, the filter order determining unit 334 performs curve fitting of the average reverberation time information for each subband by a linear equation in the log scale and obtain a slope value 'b' and a fragment value 'a' of the corresponding linear equation.

The curve-fitted filter order information $N'_{Filter}[k]$ in the subband k may be obtained through an equation given below by using the obtained coefficients.

$$N'_{Filter}[k] = 2^{\lfloor b \log k + a + 0.5 \rfloor} \quad \text{[Equation 6]}$$

That is, the curve-fitted filter order information may be determined as a value of power of 2 using an approximated integer value of a polynomial curve-fitted value of the average reverberation time information of the corresponding subband as the index. In other words, the curve-fitted filter order information may be determined as a value of power of 2 using a round off value, a round up value, or a round down value of the polynomial curve-fitted value of the average reverberation time information of the corresponding subband as the index. When the original length of the corresponding subband filter coefficients, that is, the length up to the last time slot $n_{end}$ is smaller than the value determined in Equation 6, the filter order information may be substituted with the original length value $n_{end}$ of the subband filter coefficients. That is, the filter order information may be determined as a smaller value of the reference truncation length determined by Equation 6 and the original length of the subband filter coefficients.

According to the exemplary embodiment of the present invention, based on whether proto-type BRIR filter coefficients, that is, the BRIR filter coefficients of the time domain are the HRIR filter coefficients (flag_HRIR), the filter order information may be obtained by using any one of Equation 5 and Equation 6. As described above, a value of flag_HRIR may be determined based on whether the length of the proto-type BRIR filter coefficients is more than a predetermined value. When the length of the proto-type BRIR filter coefficients is more than the predetermined value (that is, flag_HRIR=0), the filter order information may be determined as the curve-fitted value according to Equation 6 given above. However, when the length of the proto-type BRIR filter coefficients is not more than the predetermined value (that is, flag_HRIR=1), the filter order information may be determined as a non-curve-fitted value according to Equation 5 given above. That is, the filter order information may be determined based on the average reverberation time information of the corresponding subband without performing the curve fitting. The reason is that since the HRIR is not influenced by a room, a tendency of the energy decay is not apparent in the HRIR.

Meanwhile, according to the exemplary embodiment of the present invention, when the filter order information for a 0-th subband (that is, subband index 0) is obtained, the average reverberation time information in which the curve fitting is not performed may be used. The reason is that the reverberation time of the 0-th subband may have a different tendency from the reverberation time of another subband due to an influence of a room mode, and the like. Therefore, according to the exemplary embodiment of the present invention, the curve-fitted filter order information according to Equation 6 may be used only in the case of flag_HRIR=0 and in the subband in which the index is not 0.

The filter order information of each subband determined according to the exemplary embodiment given above is transferred to the VOFF filter coefficient generating unit 336. The VOFF filter coefficient generating unit 336 generates the truncated subband filter coefficients based on the obtained filter order information. According to the exemplary embodiment of the present invention, the truncated subband filter coefficients may be constituted by at least one VOFF coefficient in which the fast Fourier transform (FFT) is performed by a predetermined block size for block-wise fast convolution. The VOFF filter coefficient generating unit 336 may generate the VOFF coefficients for the block-wise fast convolution as described below with reference to FIG. 9.

Figure 8:
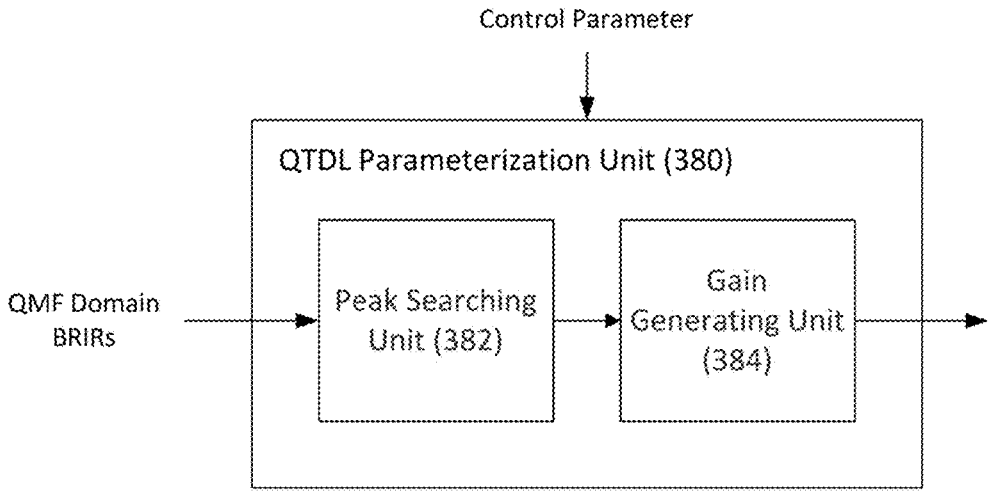
FIG. 8 is a block diagram illustrating respective components of a QTDL parameterization unit of an embodiment of the present invention.

FIG. 8 is a block diagram illustrating respective components of a QTDL parameterization unit of the present invention. As illustrated in FIG. 13, the QTDL parameterization unit 380 may include a peak searching unit 382 and a gain generating unit 384. The QTDL parameterization unit 380 may receive the QMF domain subband filter coefficients from the VOFF parameterization unit 320. Further, the QTDL parameterization unit 380 may receive the information Kproc of the number of frequency bands for performing the binaural rendering and information Kconv of the number of frequency bands for performing the convolution as the control parameters and generate the delay information and the gain information for each frequency band of a subband group (that is, the second subband group) having kMax and kConv as boundaries.

According to a more detailed exemplary embodiment, when the BRIR subband filter coefficient for the input channel index m, the left/right output channel index i, the subband index k, and the QMF domain time slot index n is $h_{i,m}^{k}(n)$, the delay information $d_{i,m}^{k}$ and the gain information $g_{i,m}^{k}$ may be obtained as described below.

$$d_{i,m}^{k} = \underset{n}{\operatorname{argmax}}\left(|h_{i,m}^{k}(n)|^2\right) \quad \text{[Equation 7]}$$

$$g_{i,m}^{k} = \operatorname{sign}\{h_{i,m}^{k}(d_{i,m}^{k})\}\sqrt{\sum_{l=0}^{n_{end}} |h_{i,m}^{k}(l)|^2} \quad \text{[Equation 8]}$$

Where, sign{x} represents the sign of value x, $n_{end}$ represents the last time slot of the corresponding subband filter coefficients.

That is, referring to Equation 7, the delay information may represent information of a time slot where the corresponding BRIR subband filter coefficient has a maximum size and this represents positional information of a maximum peak of the corresponding BRIR subband filter coefficients. Further, referring to Equation 8, the gain information may be determined as a value obtained by multiplying the total power value of the corresponding BRIR subband filter coefficients by a sign of the BRIR subband filter coefficient at the maximum peak position.

The peak searching unit 382 obtains the maximum peak position that is, the delay information in each subband filter coefficients of the second subband group based on Equation 7. Further, the gain generating unit 384 obtains the gain information for each subband filter coefficients based on Equation 8. Equation 7 and Equation 8 show an example of equations obtaining the delay information and the gain information, but a detailed form of equations for calculating each information may be variously modified.

<Block-Wise Fast Convolution>

Meanwhile, according to the exemplary embodiments of the present invention, predetermined block-wise fast convolution may be performed for optimal binaural in terms of efficiency and performance. The FFT based fast convolution has a feature in that as the FFT size increases, the computational amount decreases, but the overall processing delay increases and a memory usage increases. When a BRIR having a length of 1 second is fast-convoluted to the FFT size having a length twice the corresponding length, it is efficient in terms of the computational amount, but a delay corresponding to 1 second occurs and a buffer and a processing memory corresponding thereto are required. An audio signal processing method having a long delay time is not suitable for an application for real-time data processing, and the like. Since a frame is a minimum unit by which decoding can be performed by the audio signal processing apparatus, the block-wise fast convolution is preferably performed with a size corresponding to the frame unit even in the binaural rendering.

Figure 9:
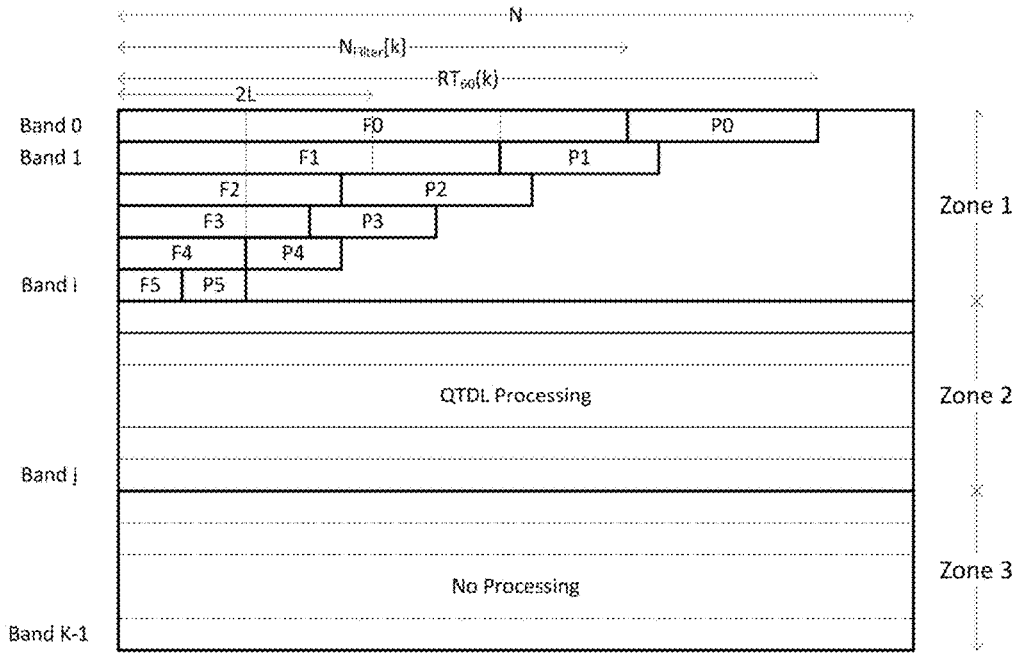
FIG. 9 is a diagram illustrating an exemplary embodiment of a method for generating VOFF coefficients for block-wise fast convolution.

FIG. 9 illustrates an exemplary embodiment of a method for generating VOFF coefficients for block-wise fast convolution. Similarly to the aforementioned exemplary embodiment, in the exemplary embodiment of FIG. 9, the proto-type FIR filter is converted into K subband filters and Fk and Pk represent the truncated subband filter (front subband filter) and rear subband filter of the subband k, respectively. Each of the subbands Band 0 to Band K−1 may represent the subband in the frequency domain, that is, the QMF subband. In the QMF domain, a total of 64 subbands may be used, but the present invention is not limited thereto. Further, N represents the length (the number of taps) of the original subband filter and $N_{Filter}[k]$ represents the length of the front subband filter of subband k.

Like the aforementioned exemplary embodiment, a plurality of subbands of the QMF domain may be classified into a first subband group (Zone 1) having low frequencies and a second subband group (Zone 2) having high frequencies based on a predetermined frequency band (QMF band i). Alternatively, the plurality of subbands may be classified into three subband groups, that is, a first subband group (Zone 1), a second subband group (Zone 2), and a third subband group (Zone 3) based on a predetermined first frequency band (QMF band i) and a second frequency band (QMF band j). In this case, the VOFF processing using the block-wise fast convolution may be performed with respect to input subband signals of the first subband group and the QTDL processing may be performed with respect to the input subband signals of the second subband group, respectively. In addition, rendering may not be performed with respect to the subband signals of the third subband group. According to the exemplary embodiment, the late reverberation processing may be additionally performed with respect to the input subband signals of the first subband group.

Referring to FIG. 9, the VOFF filter coefficient generating unit 336 of the present invention performs fast Fourier transform of the truncated subband filter coefficients by a predetermined block size in the corresponding subband to generate VOFF coefficients. In this case, the length $N_{FFT}[k]$ of the predetermined block in each subband k is determined based on a predetermined maximum FFT size 2 L. In more detail, the length $N_{FFT}[k]$ of the predetermined block in subband k may be expressed by the following equation.

$$N_{FFT}[k]=\min(2L,2^{\lceil \log_2 2N_{Filter}[k]\rceil}) \quad \text{[Equation 9]}$$

Where, 2 L represents a predetermined maximum FFT size and $N_{Filter}[k]$ represents filter order information of subband k.

That is, the length $N_{FFT}[k]$ of the predetermined block may be determined as a smaller value between a value $2^{\lceil \log_2 2N_{Filter}[k]\rceil}$ twice a reference filter length of the truncated subband filter coefficients and the predetermined maximum FFT size 2 L. Herein, the reference filter length represents any one of a true value and an approximate value in a form of power of 2 of a filter order $N_{Filter}[k]$ (that is, the length of the truncated subband filter coefficients) in the corresponding subband k. That is, when the filter order of subband k has the form of power of 2, the corresponding filter order $N_{Filter}[k]$ is used as the reference filter length in subband k and when the filter order $N_{Filter}[k]$ of subband k does not have the form of power of 2 (e.g., $n_{end}$), a round off value, a round up value or a round down value in the form of power of 2 of the corresponding filter order $N_{Filter}[k]$ is used as the reference filter length. Meanwhile, according to the exemplary embodiment of the present invention, both the length $N_{FFT}[k]$ of the predetermined block and the reference filter length $2^{\lceil \log_2 2N_{Filter}[k]\rceil}$ may be the power of 2 value.

When a value which is twice as large as the reference filter length is equal to or larger than (or larger than) a maximum FFT size 2 L like F0 and F1 of FIG. 9, each of predetermined block lengths $N_{FFT}[0]$ and $N_{FFT}[1]$ of the corresponding subbands is determined as the maximum FFT size 2 L. However, when the value which is twice as large as the reference filter length is smaller than (or equal to or smaller than) the maximum FFT size 2 L like F5 of FIG. 9, a predetermined block length $N_{FFT}[5]$ of the corresponding subband is determined as $2^{\lceil \log_2 2N_{Filter}[5]\rceil}$ which is the value twice as large as the reference filter length. As described below, since the truncated subband filter coefficients are extended to a doubled length through the zero-padding and thereafter, fast-Fourier transformed, the length $N_{FFT}[k]$ of the block for the fast Fourier transform may be determined based on a comparison result between the value twice as large as the reference filter length and the predetermined maximum FFT size 2 L.

As described above, when the block length $N_{FFT}[k]$ in each subband is determined, the VOFF filter coefficient generating unit 336 performs the fast Fourier transform of the truncated subband filter coefficients by the determined block size. In more detail, the VOFF filter coefficient generating unit 336 partitions the truncated subband filter coefficients by the half $N_{FFT}[k]/2$ of the predetermined block size. An area of a dotted line boundary of the VOFF processing part illustrated in FIG. 9 represents the subband filter coefficients partitioned by the half of the predetermined block size. Next, the BRIR parameterization unit generates temporary filter coefficients of the predetermined block size $N_{FFT}[k]$ by using the respective partitioned filter coefficients. In this case, a first half part of the temporary filter coefficients is constituted by the partitioned filter coefficients and a second half part is constituted by zero-padded values. Therefore, the temporary filter coefficients of the length $N_{FFT}[k]$ of the predetermined block is generated by using the filter coefficients of the half length $N_{FFT}[k]/2$ of the predetermined block. Next, the BRIR parameterization unit performs the fast Fourier transform of the generated temporary filter coefficients to generate VOFF coefficients. The generated VOFF coefficients may be used for a predetermined block-wise fast convolution for an input audio signal.

As described above, according to the exemplary embodiment of the present invention, the VOFF filter coefficient generating unit 336 performs the fast Fourier transform of the truncated subband filter coefficients by the block size determined independently for each subband to generate the VOFF coefficients. As a result, a fast convolution using different numbers of blocks for each subband may be performed. In this case, the number $N_{blk}[k]$ of blocks in subband k may satisfy the following equation.

$$N_{blk}[k] = \frac{2^{\lceil \log_2 2N_{Filter}[k]\rceil}}{N_{FFT}[k]} \quad \text{[Equation 10]}$$

Where, $N_{blk}[k]$ is a natural number.

That is, the number $N_{blk}[k]$ of blocks in subband k may be determined as a value acquired by dividing the value twice the reference filter length in the corresponding subband by the length $N_{FFT}[k]$ of the predetermined block.

Meanwhile, according to the exemplary embodiment of the present invention, the generating process of the predetermined block-wise VOFF coefficients may be restrictively performed with respect to the front subband filter Fk of the first subband group. Meanwhile, according to the exemplary embodiment, the late reverberation processing for the subband signal of the first subband group may be performed by the late reverberation generating unit as described above. According to the exemplary embodiment of the present invention, the late reverberation processing for an input audio signal may be performed based on whether the length of the proto-type BRIR filter coefficients is more than the predetermined value. As described above, whether the length of the proto-type BRIR filter coefficients is more than the predetermined value may be represented through a flag (that is, flag_HRIR) indicating that the length of the proto-type BRIR filter coefficients is more than the predetermined value. When the length of the proto-type BRIR filter coefficients is more than the predetermined value (flag_HRIR=0), the late reverberation processing for the input audio signal may be performed. However, when the length of the proto-type BRIR filter coefficients is not more than the predetermined value (flag_HRIR=1), the late reverberation processing for the input audio signal may not be performed.

When late reverberation processing is not be performed, only the VOFF processing for each subband signal of the first subband group may be performed. However, a filter order (that is, a truncation point) of each subband designated for the VOFF processing may be smaller than a total length of the corresponding subband filter coefficients, and as a result, energy mismatch may occur. Therefore, in order to prevent the energy mismatch, according to the exemplary embodiment of the present invention, energy compensation for the truncated subband filter coefficients may be performed based on flag_HRIR information. That is, when the length of the proto-type BRIR filter coefficients is not more than the predetermined value (flag_HRIR=1), the filter coefficients of which the energy compensation is performed may be used as the truncated subband filter coefficients or each VOFF coefficients constituting the same. In this case, the energy compensation may be performed by dividing the subband filter coefficients up to the truncation point based on the filter order information $N_{Filter}[k]$ by filter power up to the truncation point, and multiplying total filter power of the corresponding subband filter coefficients. The total filter power may be defined as the sum of the power for the filter coefficients from the initial sample up to the last sample $n_{end}$ of the corresponding subband filter coefficients.

Figure 10:
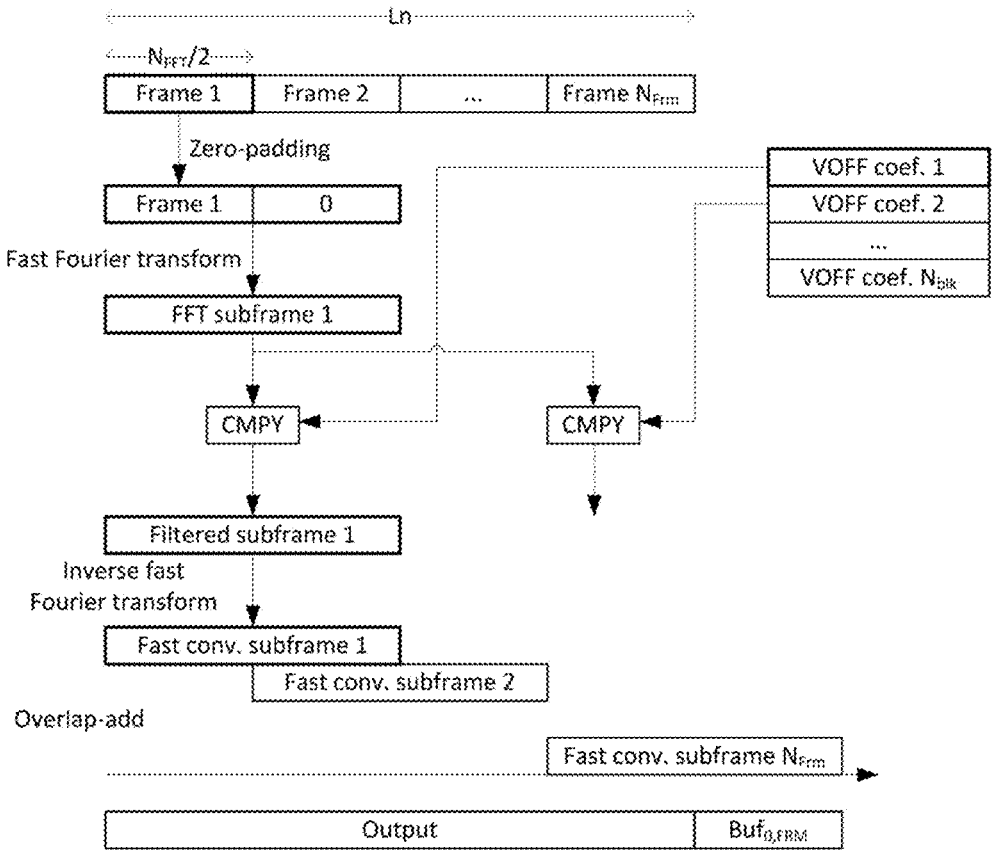
FIG. 10 is a diagram illustrating an exemplary embodiment of a procedure of an audio signal processing in a fast convolution unit according to the present invention.

FIG. 10 illustrates an exemplary embodiment of a procedure of an audio signal processing in a fast convolution unit according to the present invention. According to the exemplary embodiment of FIG. 10, a fast convolution unit of the present invention performs block-wise fast convolution to filter an input audio signal.

First, the fast convolution unit obtains at least one VOFF coefficients constituting truncated subband filter coefficients for filtering each subband signal. To this end, the fast convolution unit may receive the VOFF coefficients from the BRIR parameterization unit. According to another exemplary embodiment of the present invention, the fast convolution unit (alternatively, the binaural rendering unit including the same) receives the truncated subband filter coefficients from the BRIR parameterization unit and fast Fourier-transforms the truncated subband filter coefficients by a predetermined block size to generate the VOFF coefficients. According to the exemplary embodiment, a predetermined block length $N_{FFT}[k]$ in each subband k is determined and VOFF coefficients VOFF coef.1 to VOFF coef.$N_{blk}$ of a number corresponding to the number $N_{blk}[k]$ of blocks in the corresponding subband k are obtained.

Meanwhile, the fast convolution unit performs fast Fourier transform of each subband signal of the input audio signal by the predetermined subframe size in the corresponding subband. In order to perform the block-wise fast convolution between the input audio signal and the truncated subband filter coefficients, the length of the subframe is determined based on the predetermined block length $N_{FFT}[k]$ in the corresponding subband. According to the exemplary embodiment of the present invention, since the respective partitioned subframes are extended to a length of twice through zero-padding and thereafter, subjected to the fast Fourier transform, the length of the subframe may be determined as a length which is a half as large as the predetermined block, that is, $N_{FFT}[k]/2$. According to the exemplary embodiment of the present invention, the length of the subframe may be set to have an involution value of 2.

When the length of the subframe is determined as described above, the fast convolution unit partitions each subband signal into the predetermined subframe size $N_{FFT}[k]/2$ of the corresponding subband. If the length of a frame of the input audio signal in time domain samples is L, the length of the corresponding frame in QMF domain time slots may be Ln and the corresponding frame may be partitioned into $N_{Frm}[k]$ subframes as shown in an equation given below.

$$N_{Frm}[k] = \max\left(1, \frac{Ln}{N_{FFT}[k]/2}\right) \quad \text{[Equation 11]}$$

That is, the number $N_{Frm}[k]$ of subframes for the fast convolution in the subband k is a value obtained by dividing a total length Ln of the frame by the length $N_{FFT}[k]/2$ of the subframe and $N_{Frm}[k]$ may be determined to have a value equal to or greater than 1. In other words, the number $N_{Frm}[k]$ of subframes is determined as the larger value between the value obtained by dividing the total length Ln of the frame by $N_{FFT}[k]/2$ and 1. Herein, the frame length Ln in the QMF domain time slots is a value which is in proportion to the frame length L in the time domain samples and when L is 4096, Ln may be set to 64 (that is, Ln=L/64).

The fast convolution unit generates temporary subframes each having a length (that is, the length $N_{FFT}[k]$) which is two times larger than the subframe length by using the partitioned subframes Frame 1 to Frame $N_{Frm}$. In this case, a first half part of the temporary subframe is constituted by the partitioned subframes and a second half part is constituted by zero-padded values. The fast convolution unit generates an FFT subframe by fast Fourier-transforming the generated temporary subframe.

Next, the fast convolution unit multiplies the fast Fourier-transformed subframe (that is, FFT subframe) and the VOFF coefficients by each other to generate the filtered subframe. A complex multiplier (CMPY) of the fast convolution unit performs complex multiplication between the FFT subframe and the VOFF coefficients to generate the filtered subframe. Next, the fast convolution unit inverse fast Fourier transforms each filtered subframe to generate the fast-convoluted subframe (Fast conv. subframe). The fast convolution unit overlap-adds at least one subframe (Fast conv. subframe) which is inverse fast-Fourier transformed to generate the filtered subband signal. The filtered subband signal may constitute an output audio signal in the corresponding subband. According to the exemplary embodiment, in a step before or after the inverse fast Fourier transform, the filtered subframe may be aggregated into subframes for left and right output channels of the subframes for each channel in the same subband.

In order to minimize a computational amount of the inverse fast Fourier transform, the filtered subframe obtained by performing complex multiplication with VOFF coefficients after a first VOFF coefficients of the corresponding subband, that is, VOFF coef. m (m is equal to or greater than 2 and equal to or smaller than $N_{blk}$) may be stored in a memory (buffer) and aggregated when a subframe after a current subframe is processed and thereafter, inverse fast Fourier-transformed. For example, the filtered subframe obtained through the complex multiplication between a first FFT subframe (FFT subframe 1) and a second VOFF coefficients (VOFF coef. 2) is stored in the buffer and thereafter, is aggregated with the filtered subframe obtained through the complex multiplication between a second FFT subframe (FFT subframe 2) and a first VOFF coefficients (VOFF coef. 1) at a time corresponding to a second subframe and the inverse fast Fourier transform may be performed with respect to the aggregated subframe. Similarly, each of the filtered subframe obtained through the complex multiplication between the first FFT subframe (FFT subframe 1) and a third VOFF coefficients (VOFF coef. 3) and the filtered subframe obtained through the complex multiplication between the second FFT subframe (FFT subframe 2) and the second VOFF coefficients (VOFF coef. 2) may be stored in the buffer. The filtered subframes stored in the buffer are aggregated with the filtered subframe obtained through the complex multiplication between a third FFT subframe (FFT subframe 3) and the first VOFF coefficients (VOFF coef. 1) at a time corresponding to a third subframe and the inverse fast Fourier transform may be performed with respect to the aggregated subframe.

According to yet another exemplary embodiment of the present invention, the length of the subframe may have a value smaller than the length $N_{FFT}[k]/2$ which is a half as large as the length of the predetermined block. In this case, the corresponding subframe may be fast Fourier-transformed after being extended to the predetermined block length $N_{FFT}[k]$ through the zero padding. Further, when the filtered subframe generated by using the complex multiplier (CMPY) of the fast convolution unit is overlap-added, an overlap interval may be determined based on not the subframe length but the length $N_{FFT}[k]/2$ which is a half as large as the length of the predetermined block.

<Binaural Rendering Syntax>

FIGS. 11 to 15 illustrate an exemplary embodiment of syntaxes for implementing a method for processing an audio signal according to the present invention. Respective functions of FIGS. 11 to 15 may be performed by the binaural renderer of the present invention, and when the binaural rendering unit and the parameterization unit are provided as separate devices, the respective functions may be performed by the binaural rendering unit. Therefore, in the following description, the binaural renderer may mean the binaural rendering unit according to the exemplary embodiment. In the exemplary embodiment of FIGS. 11 to 15, each variable received in the bitstream and the number of bits and a type of mnemonic allocated to the corresponding variable are written in parallel. In the type of the mnemonic, 'uimsbf' represents unsigned integer most significant bit first, and 'bslbf' represents bit string left bit first. The syntaxes of FIGS. 11 to 15 represent the exemplary embodiment for implementing the present invention and detailed allocation values of each variable may be modified and substituted.

FIG. 11 illustrates a syntax of a binaural rendering function (S1100) according to an exemplary embodiment of the present invention. The binaural rendering according to the exemplary embodiment of the present invention may be performed by calling the binaural rendering function (S1100) of FIG. 11. First, the binaural rendering function obtains file information of the BRIR filter coefficients through steps S1101 to S1104. Further, information 'bsNumBinauralDataRepresentation' indicating the total number of filter representations is received (S1110). The filter representation means a unit of independent binaural data included in a single binaural rendering syntax. Different filter representations may be assigned to proto-type BRIRs having different sample frequencies although being obtained in the same space. Further, even when the same proto-type BRIR is processed by different binaural parameterization units, different filter representations may be assigned to the same proto-type BRIR.

Next, steps S1111 to S1350 are repeated based on the received 'bsNumBinauralDataRepresentation' value. First, 'brirSamplingFrequencyIndex' which is an index for determining a sampling frequency value of the filter representation (that is, BRIR) is received (S1111). In this case, a value corresponding to the index may be obtained as the BRIR sampling frequency value by referring to a predefined table. When the index is a predetermined specific value (that is, brirSamplingFrequencyIndex==0x1f), the BRIR sampling frequency value 'brirSamplingFrequency' may be directly received from the bitstream.

Next, the binaural rendering function receives 'bsBinauralDataFormatID' which is type information of a BRIR filter set (S1113). According to the exemplary embodiment of the present invention, the BRIR filter set may have a type of a finite impulse response (FIR) filter, a frequency domain (FD) parameterized filter, or a time domain (TD) parameterized filter. In this case, a type of the BRIR filter set to be obtained by the binaural renderer is determined based on the type information (S1115). When the type information indicates the FIR filter (that is, when bsBinauralDataFormatID==0), a BinauralFIRData( ) function (S1200) may be executed and therefore, the binaural renderer may receive proto-type FIR filter coefficients which are not transformed and edited. When the type information indicates the FD parameterized filter (that is, when bsBinauralDataFormatID==1), an FDBinauralRendererParam( ) function (S1300) may be executed and therefore, the binaural renderer may obtain the VOFF coefficients and the QTDL parameter in the frequency domain as the aforementioned exemplary embodiment. When the type information indicates the TD parameterized filter (that is, when bsBinauralDataFormatID==2), a TDBinauralRendererParam( ) function (S1350) may be executed and therefore, the binaural renderer receives the parameterized BRIR filter coefficients in the time domain.

FIG. 12 illustrates a syntax of the BinauralFirData( ) function (S1200) for receiving the proto-type BRIR filter coefficients. BinauralFirData( ) is an FIR filter obtaining function for receiving the proto-type FIR filter coefficients which are not transformed and edited. First, the FIR filter obtaining function receives filter coefficient number information 'bsNumCoef' of the proto-type FIR filter (S1201). That is, 'bsNumCoef' may represent the length of the filter coefficients of the proto-type FIR filter.

Next, the FIR filter obtaining function receives FIR filter coefficients for each FIR filter index pos and a sample index i in the corresponding FIR filter (S1202 and S1203). Herein, the FIR filter index pos represents an index of the corresponding FIR filter pair (that is, a left/right output pair) in the number 'nBrirPairs' of transmitted binaural filter pairs. The number 'nBrirPairs' of transmitted binaural filter pairs may indicate the number of virtual speakers, the number of channels, or the number of HOA components to be filtered by the binaural filter pair. Further, the index i indicates a sample index in each FIR filter coefficients having the length of 'bsNumCoefs'. The FIR filter obtaining function receives each of FIR filter coefficients of a left output channel (S1202) and FIR filter coefficients of a right output channel (S1203) for each index pos and i.

Next, the FIR filter obtaining function receives 'bsAllCutFreq' which is information indicating a maximum effective frequency of the FIR filter (S1210). In this case, the 'bsAllCutFreq' has a value of 0 when respective channels have different maximum effective frequencies and a value other than 0 when all channels have the same maximum effective frequency. When the respective channels have different maximum effective frequencies (that is, bsAllCutFreq==0), the FIR filter obtaining function receives maximum effective frequency information 'bsCutFreqLeft[pos]' of the FIR filter of the left output channel and maximum effective frequency information 'bsCutFreqRight[pos]' of the right output channel for each FIR filter index pos (S1211 and S1212). However, when all of the channels have the same maximum effective frequency, each of the maximum effective frequency information 'bsCutFreqLeft[pos]' of the FIR filter of the left output channel and the maximum effective frequency information 'bsCutFreqRight[pos]' of the right output channel is allocated with the value of 'bsAllCutFreq' (S1213 and S1214).

FIG. 13 illustrates a syntax of an FdBinauralRendererParam( ) function (S1300) according to an exemplary embodiment of the present invention. The FdBinauralRendererParam( ) function (S1300) is a frequency domain parameter obtaining function and receives various parameters for the frequency domain binaural filtering.

First, information 'flagHrir' is received, which indicates whether impulse response (IR) filter coefficients input into the binaural renderer are the HRIR filter coefficients or the BRIR filter coefficients (S1302). According to the exemplary embodiment, 'flagHrir' may be determined based on whether the length of the proto-type BRIR filter coefficients received by the parameterization unit is more than a predetermined value. Further, propagation time information 'dInit' indicating a time from an initial sample of the proto-type filter coefficients to a direct sound is received (S1303). The filter coefficients transferred by the parameterization unit may be filter coefficients of a remaining part after a part corresponding to the propagation time is removed from the proto-type filter coefficients. Moreover, the frequency domain parameter obtaining function receives number information 'kMax' of frequency bands to perform the binaural rendering, number information 'kConv' of frequency bands to perform the convolution, and number information 'kAna' of frequency bands to perform late reverberation analysis (S1304, S1305, and S1306).

Next, the frequency domain parameter obtaining function executes a 'VoffBrirParam( )' function to receive a VOFF parameter (S1400). When the input IR filter coefficients are the BRIR filter coefficients (that is, when flagHrir==0), an 'SfrBrirParam( )' function is additionally executed, and as a result, a parameter for late reverberation processing may be received (S1450). Further, the frequency domain parameter obtaining function executes a 'QtdlBrirParam( )' function to receive a QTDL parameter (S1500).

FIG. 14 illustrates a syntax of a VoffBrirParam( ) function (S1400) according to an exemplary embodiment of the present invention. The VoffBrirParam( ) function (S1400) is a VOFF parameter obtaining function and receives VOFF coefficients for VOFF processing and parameters associated therewith.

First, in order to receive truncated subband filter coefficients for each subband and parameters indicating numerical characteristics of the VOFF coefficients constituting the subband filter coefficients, the VOFF parameter obtaining function receives bit number information allocated to corresponding parameters. That is, bit number information 'nBitNFilter' of a filter order, bit number information 'nBitNFft' of the block length, and bit number information 'nBitNBlk' of a block number are received (S1401, S1402, and S1403).

Next, the VOFF parameter obtaining function repeatedly performs steps S1410 to S1423 with respect to each frequency band k to perform the binaural rendering. In this case, with respect to kMax which is the number information of the frequency band to perform the binaural rendering, the subband index k has values from 0 to kMax−1.

In detail, the VOFF parameter obtaining function receives filter order information 'nFilter[k]' of the corresponding subband k, block length (that is, FFT size) information 'nFft[k]' of the VOFF coefficients, and the block number information 'nBlk[k]' for each subband (S1410, S1411, and S1413). According to the exemplary embodiment of the present invention, the block-wise VOFF coefficients set for each subband may be received and the predetermined block length, that is, the VOFF coefficients length may be determined as the value of power of 2. Therefore, the block length information 'nFft[k]' received by the bitstream may indicate an exponent value of the VOFF coefficients length and the binaural renderer may calculate 'fftLength' which is the length of the VOFF coefficients through 2 to the 'nFft[k]' (S1412).

Next, the VOFF parameter obtaining function receives the VOFF coefficients for each subband index k, a block index b, a BRIR index nr, and a frequency domain time slot index v in the corresponding block (S1420 to S1423). Herein, the BRIR index nr indicates the index of the corresponding BRIR filter pair in 'nBrirPairs' which is the number of transmitted binaural filter pairs. The number 'nBrirPairs' of transmitted binaural filter pairs may indicate the number of virtual speakers, the number of channels, or the number of HOA components to be filtered by the binaural filter pair. Further, the index b represents an index of the corresponding VOFF coefficients block in 'nBlk[k]' which is the number of all blocks in the corresponding subband k. The index v represents a time slot index in each block having a length of 'fftLength'. The VOFF parameter obtaining function receives each of a left output channel VOFF coefficient (S1420) of a real value, a left output channel VOFF coefficient (S1421) of an imaginary value, a right output channel VOFF coefficient (S1422) of the real value, and a right output channel VOFF coefficient (S1423) of the imaginary value for each of the indexes k, b, nr and v. The binaural renderer of the present invention receives VOFF coefficients corresponding to each BRIR filter pair nr per block b of the fftLength length determined in the corresponding subband with respect to each subband k and performs the VOFF processing by using the received VOFF coefficients as described above.

According to the exemplary embodiment of the present invention, the VOFF coefficients are received with respect to all frequency bands (subband indexes 0 to kMax−1) to which the binaural rendering is performed. That is, the VOFF parameter obtaining function receives the VOFF coefficients for all subbands of a second subband group as well as a first subband group. When the QTDL processing is performed with respect to each subband signal of the second subband group, the binaural renderer may perform the VOFF processing only with respect to the subbands of the first subband group. However, when the QTDL processing is not performed with respect to each subband signal of the second subband group, the binaural renderer may perform the VOFF processing with respect to each subband of the first subband group and the second subband group.

FIG. 15 illustrates a syntax of a QtdlParam( ) function (S1500) according to an exemplary embodiment of the present invention. The QtdlParam( ) function (S1500) is a QTDL parameter obtaining function and receives at least one parameter for the QTDL processing. In the exemplary embodiment of FIG. 15, duplicated description of the same part as the exemplary embodiment of FIG. 14 will be omitted.

According to the exemplary embodiment of the present invention, the QTDL processing may be performed with respect to the second subband group, that is, each frequency band between the subband indexes kConv and kMax−1. Therefore, the QTDL parameter obtaining function repeatedly performs steps S1501 to S1507 kMax-kConv times with respect to the subband index k to receive the QTDL parameter for each subband of the second subband group.

First, the QTDL parameter obtaining function receives bit number information 'nBitQtdlLag[k]' allocated to delay information of each subband (S1501). Next, the QTDL parameter obtaining function receives the QTDL parameters, that is, gain information and delay information for each subband index k and the BRIR index nr (S1502 to S1507). In more detail, the QTDL parameter obtaining function receives each of real value information (S1502) of a left output channel gain, imaginary value information (S1503) of the left output channel gain, real value information (S1504) of a right output channel gain, imaginary value information (S1505) of the right output channel gain, left output channel delay information (S1506), and right output channel delay information (S1507) for each of the indexes k and nr. According to the exemplary embodiment of the present invention, the binaural renderer receives gain information of the real value, and gain information and delay information of the imaginary value of the left/right output channel for each subband k and each BRIR filter pair nr of the second subband group, and performs one-tap-delay line filtering for each subband signal of the second subband group by using the gain information of the real value, and the gain information and the delay information of the imaginary value.

<Variant Exemplary Embodiment of VOFF Processing>

Meanwhile, according to another exemplary embodiment of the present invention, the binaural renderer may perform channel dependent VOFF processing. To this end, the filter orders of the respective subband filter coefficients may be set differently from each other for each channel. For example, the filter order for front channels in which the input signals have more energy may be set to be higher than the filter order for rear channels in which the input signals have relatively smaller energy. Therefore, a resolution reflected after the binaural rendering is increased with respect to the front channels and the rendering may be performed with a small computational amount with respect to the rear channels. Herein, classification of the front channels and the rear channels is not limited to a channel name allocated to each channel of the multi-channel input signal and the respective channels may be classified into the front channels and the rear channels based on a predetermined spatial reference. Further, according to an additional exemplary embodiment of the present invention, the respective channels of the multi-channels may be classified into three or more channel groups based on the predetermined spatial reference and different filter orders may be used for each channel group. Alternatively, as the filter order of the subband filter coefficients corresponding to each channel, values to which different weights are applied may be used based on positional information of the corresponding channel in a virtual reproduction space.

Figure 16:
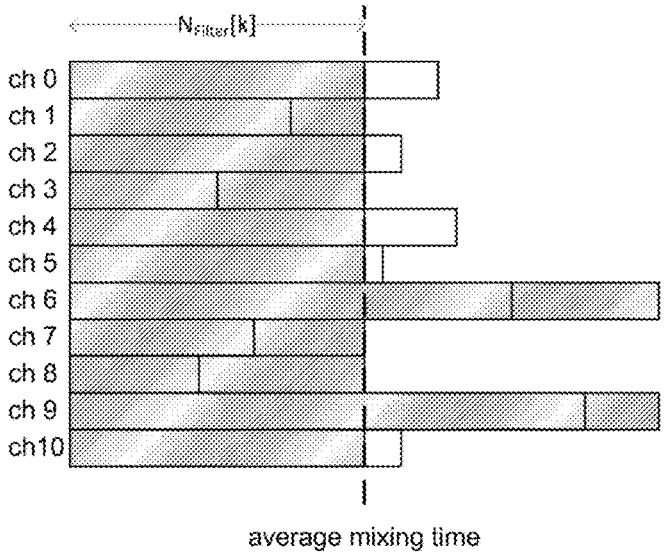
FIG. 16 is a diagram illustrating a method for determining a filter order according to a variant exemplary embodiment of the present invention.

As described above, in order to apply different filter orders for each channel, an adjusted filter order may be used with respect to a channel in which a mixing time is significantly longer than a base filter order $N_{Filter}[k]$. Referring to FIG. 16, the base filter order $N_{Filter}[k]$ of the subband k may be determined by an average mixing time of the corresponding subband and the average mixing time may be calculated based on an average value (that is, average reverberation time information) of the reverberation time information for each channel of the corresponding subband as described in Equation 4. However, the adjusted filter order may be applied to channel #6 (ch 6) and channel #9 (ch 9) in which individual mixing times are larger than the average mixing time by a predetermined value or more. When the reverberation time information of the subband filter coefficients for the input channel index m, the left/right output channel index i, and the subband index k is RT(k, m, i) and the base filter order of the corresponding subband is $N_{Filter}[k]$, the filter order $N_{Filter}^{i,m}[k]$ adjusted for each channel may be obtained as shown in an equation given below.

$$N_{Filter}^{i,m}[k] = \left\lfloor \frac{RT(k, m, i)}{N_{Filter}[k]} + 0.5 \right\rfloor N_{Filter}[k] \quad \text{[Equation 12]}$$

That is, the adjusted filter order may be determined as integer times of the base filter order of the corresponding subband and magnification of the adjusted filter order for the base filter order may be determined as a value obtained by rounding off a ratio of the reverberation time information of the corresponding channel to the base filter order. Meanwhile, according to the exemplary embodiment of the present invention, the base filter order of the corresponding subband may be determined as the $N_{Filter}[k]$ value according to Equation 5, but according to another exemplary embodiment, curve fitted $N'_{Filter}[k]$ according to Equation 6 may be used as the base filter order. Further, the magnification of the adjusted filter order may be determined as other approximate values including a rounding up value, a rounding down value, and the like of the ratio of the reverberation time information of the corresponding channel to the base filter order. When the adjusted filter order is applied for each channel as described above, a parameter for the late reverberation processing may also be adjusted in response to a change of the filter order.

According to yet another exemplary embodiment of the present invention, the binaural renderer may perform scalable VOFF processing. In the aforementioned exemplary embodiment, it is described that the reverberation time information RT20 is used for determining the filter order for each subband. However, as longer reverberation time information is used, that is, as VOFF part to BRIR Energy Ratio (VBER) is higher, the quality and the complexity of the binaural rendering increase and vice versa. According to the exemplary embodiment of the present invention, the binaural renderer may select the VBER of the truncated subband filter coefficients used for the VOFF processing. That is, the parameterization unit may provide the truncated subband filter coefficients based on the maximum VBER and the binaural renderer obtaining the truncated subband filter coefficients may adjust the VBER of the truncated subband filter coefficients to be used for the VOFF processing based on device state information such as the computational amount, a residual battery capacity, and the like of the corresponding device or a user input. For example, the parameterization unit may provide the truncated subband filter coefficients (that is, the subband filter coefficients truncated by the filter order determined by using RT40) of VBER 40 and the binaural renderer may select VBER of VBER 40 (maximum VBER) or less according to the state information of the corresponding device. When VBER (that is, VBER 10) smaller than the maximum VBER is selected, the binaural renderer may re-truncate each subband filter coefficients based on the selected VBER (that is, VBER 10) and perform the VOFF processing by using the re-truncated subband filter coefficients. However, in the present invention, the maximum VBER is not limited to the VBER 40 and a value larger or smaller than the VBER 40 may be used as the maximum VBER.

FIGS. 17 and 18 illustrate syntaxes of an FdBinauralRendererParam2( ) function (S1700) and a VoffBrirParam2( ) function (S1800) for implementing the variant exemplary embodiment. The FdBinauralRendererParam2( ) function (S1700) and the VoffBrirParam2( ) function (S1800) of FIGS. 17 and 18 are the frequency domain parameter obtaining function and the VOFF parameter obtaining function according to the variant exemplary embodiment of the present invention, respectively. In the exemplary embodiment of FIGS. 17 and 18, duplicated description of the same part as the exemplary embodiment of FIGS. 13 and 14 will be omitted.

First, referring to FIG. 17, the frequency domain parameter obtaining function sets an output channel number nOut as 2 (S1701) and receives various parameters for binaural filtering in the frequency domain through steps S1702 to S1706. Steps S1702 to S1706 may be performed similarly to steps S1302 to S1306 of FIG. 13, respectively. Next, the frequency domain parameter obtaining function receives VBER number information 'nVBER' and a flag 'flagChannelDependent' indicating whether channel dependent VOFF processing is performed (S1707 and S1708). Herein, 'nVBER' may represent information on the number of VBERs usable in the VOFF processing of the binaural renderer and in more detail, represent the number of reverberation time information usable for determining the filter order of the truncated subband filter coefficients. For example, when the truncated subband filter coefficients for any one of RT10, RT20, and RT40 is usable in the binaural renderer, 'nVBER' may be determined as 3.

Next, the frequency domain parameter obtaining function repeatedly performs steps S1710 to S1714 with respect to the VBER index n. In this case, the VBER index n may have a value between 0 and nVBER−1 and a higher index may indicate a higher RT value. In more detail, VOFF processing complexity information ('VoffComplexity[n]') is received with respect to each VBER index n (S1710) and the filter order information is received based on the value of 'flagChannelDepedent'. When the channel dependent VOFF processing is performed (that is, when flagChannelDependent==1), the frequency domain parameter obtaining function receives bit number information 'nBitNFilter[nr][n]' allocated at each filter order for VBER index n and BRIR index nr (S1711) and receives each filter order information 'nFilter[nr] [n] [k]' for a combination of the VBER index n, the BRIR index nr, and the subband index k (S1712). However, when the channel dependent VOFF processing is not performed (that is, when flagChannelDependent==0), the frequency domain parameter obtaining function receives bit number information 'nBitNFilter[n]' allocated at each filter order for the VBER index n (S1713) and receives each filter order information 'nFilter[n][k]' for a combination of the VBER index n and the subband index k (S1714). Meanwhile, although not illustrated in the syntax of FIG. 17, the frequency domain parameter obtaining function may receive each filter order information 'nFilter[nr][k]' for a combination of the BRIR index nr and the subband index k.

As described above, according to the exemplary embodiment of FIG. 17, the filter order information may be determined with respect to additional combination of at least one of the VBER index and the BRIR index (that is, channel index) as well as each subband index. Next, the frequency domain parameter obtaining function executes a 'VoffBrirParam2( )' function to receive the VOFF parameter (S1800). As described above, when the input IR filter coefficients are the BRIR filter coefficients (that is, when flagHrir==0), an 'SfrBrirParam( )' function is additionally executed, and as a result, a parameter for late reverberation processing may be received (S1450). Further, the frequency domain parameter obtaining function executes a 'QtdlBrirParam( )' function to receive the QTDL parameter (S1500).

FIG. 18 illustrates a syntax of a VoffBrirParam2( ) function (S1800) according to an exemplary embodiment of the present invention. Referring to FIG. 18, the VOFF parameter obtaining function receives the truncated subband filter coefficients for each subband index k, the BRIR index nr, and a frequency domain time slot index v (S1820 to S1823). Herein, the index v has a value between 0 and nFilter[nVBER−1][k]−1. Therefore, the VOFF parameter obtaining function receives the truncated subband filter coefficients of the length of the filter order nFilter[nVBER−1][k] for each subband corresponding to the maximum VBER index (that is, the maximum RT value). In this case, a left output channel truncated subband filter coefficient (S1820) of a real value, a left output channel truncated subband filter coefficient (S1821) of an imaginary value, a right output channel truncated subband filter coefficient (S1822) of the real value, and a right output channel truncated subband filter coefficient (S1823) of the imaginary value for each of the indexes k, nr and v are received. As described above, when the truncated subband filter coefficients corresponding to the maximum VBER is received, the binaural renderer may re-edit the corresponding subband filter coefficients with a filter order nFilter[n] [k] depending on a VBER selected for actual rendering and use the re-edited subband filter coefficients in the VOFF processing.

As described above, according to the exemplary embodiment of FIG. 18, the binaural renderer receives the truncated subband filter coefficients having the length of the filter order nFilter[nVBER−1][k] determined in the corresponding subband with respect to each subband k and BRIR index nr and performs the VOFF processing by using the truncated subband filter coefficients. Meanwhile, although not illustrated in FIG. 18, when the channel dependent VOFF processing is performed as described in the aforementioned exemplary embodiment, the index v may have a value between nFilter[nr][nVBER−1][k]−1 at 0 and nFilter[nr][k]−1 at 0. That is, the truncated subband filter coefficients are received based on the filter order considering each BRIR index (channel index) nr together to be used in the VOFF processing.

Although the present invention has described through the detailed exemplary embodiments hereinabove, modifications and changes of the present invention can be made without departing from the gist and the scope of the present invention by those skilled in the art. That is, although in the present invention, the exemplary embodiment of the binaural rendering for the multi audio signals has been described, the present invention can be similarly applied and extended even to various multimedia signals including the audio signal and a video signal. Accordingly, it is construed that easy inferring of the present invention by those skilled in the art from the detailed description and the exemplary embodiments of the present invention is included in the claims of the present invention.

MODE FOR INVENTION

As above, related features have been described in the best mode.

INDUSTRIAL APPLICABILITY

The present invention can be applied to various forms of apparatuses for processing a multimedia signal including an apparatus for processing an audio signal and an apparatus for processing a video signal, and the like.

Furthermore, the present invention can be applied to a parameterization device for generating parameters used for the audio signal processing and the video signal processing.

What is claimed is:

1. A method for processing an audio signal, the method comprising:

receiving an input audio signal;

receiving a set of filter coefficients for each subband;

determining a scalability factor for performing a binaural rendering of the input audio signal;

obtaining a filter order for each subband based on the scalability factor, wherein the filter order is determined to be variable for each subband;

editing the set of filter coefficients for each subband based on a filter order of the corresponding subband, wherein a length of the edited set of filter coefficients is determined based on the filter order of the corresponding subband; and filtering each subband signal of the input audio signal by using the edited set of filter coefficients corresponding thereto.

2. The method of claim 1, wherein the scalability factor indicates energy ratio which determines an energy decay time of the corresponding set of filter coefficients.

3. The method of claim 2, wherein the filter order is obtained based on an energy decay time extracted from a set of proto-type filter coefficients for the corresponding subband.

4. The method of claim 1, wherein the energy decay time includes a reverberation time.

5. The method of claim 4, wherein the scalability factor is determined among reverberation time (RT)10, RT20, RT40.

6. The method of claim 1, wherein the received set of filter coefficients has a length according to a base filter order corresponding to a maximum scalability factor, and wherein the editing is performed by truncating the set of filter coefficients based on the filter order corresponding to the scalability factor determined for performing the binaural rendering.

7. An apparatus for processing an audio signal, the apparatus comprising:

a binaural renderer configured to perform filtering one or more subband signals of an input audio signal, wherein the binaural renderer is configured to:

receive an input audio signal;

receive a set of filter coefficients for each subband;

determine a scalability factor for performing a binaural rendering of the input audio signal;

obtain a filter order for each subband based on the scalability factor, wherein the filter order is determined to be variable for each subband;

edit the set of filter coefficients for each subband based on a filter order of the corresponding subband, wherein a length of the edited set of filter coefficients is determined based on the filter order of the corresponding subband; and filter each subband signal of the input audio signal by using the edited set of filter coefficients corresponding thereto.

8. The apparatus of claim 7, wherein the scalability factor indicates energy ratio which determines an energy decay time of the corresponding set of filter coefficients.

9. The apparatus of claim 8, wherein the filter order is obtained based on an energy decay time extracted from a set of proto-type filter coefficients for the corresponding subband.

10. The apparatus of claim 7, wherein the energy decay time includes a reverberation time.

11. The apparatus of claim 10, wherein the scalability factor is determined among reverberation time (RT)10, RT20, RT40.

12. The apparatus of claim 7, wherein the received set of filter coefficients has a length according to a base filter order corresponding to a maximum scalability factor, and wherein the binaural renderer performs the editing by truncating the set of filter coefficients based on the filter order corresponding to the scalability factor determined for performing the binaural rendering.

* * * * *